US006055675A

United States Patent [19]

Egger et al.

[11] Patent Number: 6,055,675

[45] **Date of Patent: *May 2, 2000**

[54] PROTECTIVE BICYCLE HELMET HAVING A VENTILATED REAR SUPPORT STRUCTURE

[75] Inventors: F. Robert Egger, Watsonville; Kurt Workman, Santa Cruz; Steven Sasaki, San Jose, all of Calif.

[73] Assignee: Specialized Bicycle Components, Inc., Morgan Hill, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/062,230

[22] Filed: Apr. 16, 1998

Related U.S. Application Data

[63] Continuation-in-part of application No. 29/064,688, Jan. 9, 1997, and a continuation-in-part of application No. 29/075,208, Aug. 8, 1997, and a continuation-in-part of application No. 29/076,025, Aug. 29, 1997, and a continuation-in-part of application No. 29/075,953, Aug. 29, 1997.

[51] Int. Cl.[7] ..... A42B 3/00

[52] U.S. Cl. ..... 2/425; 2/171.3; 2/411

[58] Field of Search ..... 2/410, 411, 424, 2/425, 421, 171.3, 417, 418

[56] References Cited

U.S. PATENT DOCUMENTS

D. 285,980 10/1986 McNabb .
D. 309,961 8/1990 Bobrick .
D. 316,165 4/1991 Gentes et al. .
D. 319,112 8/1991 Broersma .
D. 348,545 7/1994 Egger .
D. 352,803 11/1994 Sasaki et al. .
D. 361,410 8/1995 Ho .
D. 362,084 9/1995 Egger .
D. 366,731 1/1996 Garneau .
D. 367,341 2/1996 Losi, II .
D. 372,559 8/1996 Murakami .
D. 373,857 9/1996 Fujita .
D. 375,582 11/1996 Garneau .
3,972,075 8/1976 Alevras ..... 2/410
4,095,294 6/1978 Winterbottom ..... 2/424
4,903,348 2/1990 Broersma .
4,903,350 2/1990 Gentes et al. ..... 2/421
4,993,082 2/1991 Gentes et al. .
5,381,560 1/1995 Halstead .
5,450,631 9/1995 Egger .
5,619,756 4/1997 Garneau .
5,651,145 7/1997 Egger .
5,790,988 8/1998 Guadagnino, Jr. et al. ..... 2/411

*Primary Examiner*—Michael A. Neas
*Attorney, Agent, or Firm*—Blakely, Sokoloff, Taylor & Zafman LLP

[57] ABSTRACT

The invention relates to a protective bicycling helmet with a rear support structure having at least two generally vertical columns mounted in the rear portion of the helmet body for providing improved ventilation while retaining or improving the rigid structural integrity of the helmet.

24 Claims, 26 Drawing Sheets

PROTECTIVE BICYCLE HELMET HAVING A VENTILATED REAR SUPPORT STRUCTURE

This application is a continuation-in-part of application Ser. No. 29/064,688 filed Jan. 9, 1997, a continuation-in-part of Ser. No. 29/075,208 filed Aug. 8, 1997, a continuation-in-part of Ser. No. 29/076,025 filed Aug. 29, 1997, and a continuation-in-part of Ser. No. 29/075,953 filed Aug. 29, 1997.

FIELD OF THE INVENTION

The present invention relates to a cycling helmet, and more particularly to a protective cycling helmet having a rear ventilated support structure which provides rigid structural support with improved ventilation.

BACKGROUND OF THE INVENTION

Protective helmets of many varieties exist to provide head protection for bicyclists. Considerable resources have been expended in efforts to better understand head injury relating to bicycle use and to develop head gear that can provide improved safety in the event of an impact to the bicyclist's head. However, not only must a helmet provide adequate protection from serious head injury, preferably, the helmet is light weight, comfortable, and well-ventilated to help the rider stay cool. Bicycle helmets are provided with openings, so that portions of the wearer's head are exposed to ambient air for ventilation. As will be appreciated, ventilation of the helmet by providing openings can result in compromise of the structural integrity of the resulting helmet, which can in turn, reduce the effectiveness of the helmet for head protection. Therefore, there is a continuing need to provide improved ventilation in a cost effective manner while maintaining or improving the structural integrity of the helmet.

SUMMARY OF THE INVENTION

The protective helmet according to the preferred embodiments of the present invention addresses these problems by providing a rear support structure around the back of the user's head comprising generally vertical columns or pillars, and preferably openings therebetween that provide improved ventilation while maintaining rigid structural support. The helmet of the present invention also provides structural integrity with columns and support members connecting the columns.

In one aspect of the present invention, there is provided a protective helmet for a bicyclist comprising a helmet body having a crown portion and a rear portion with at least two generally vertical columns and an opening therebetween below the crown portion.

In another aspect of the present invention, there is provided a protective bicycle helmet comprising a helmet body having a crown portion and a skirt portion along an imaginary curve which generally follows an outermost perimeter of the helmet body when the helmet body is viewed in a top plan view, a rearward most portion of the skirt portion comprising at least four pillars and at least three openings.

In yet another aspect of the present invention, there is provided a bicycle helmet, comprising a helmet body having at least two generally vertical columns with a substantial portion extending below a rearward most point of the helmet and spaced on opposite sides of a centerline of the helmet body.

BRIEF DESCRIPTION OF THE DRAWING FIGURES

The invention will be described in greater detail with reference to the accompanying drawings, in which like elements bear like reference numerals, wherein.

DETAILED DESCRIPTION OF THE PREFERRED EMBODIMENTS

Referring to the figures, there are shown four exemplary embodiments of a helmet body 2. Helmet body 2 comprising crown portion 4 generally located above imaginary or phantom curve 5 and skirt portion 6 generally located below imaginary curve 5. Imaginary curve 5 generally follows the outermost perimeter of helmet body 2 when the helmet is viewed in a top plan view. Crown portion 4 in use rests upon and generally covers the upper portion of the user's (i.e., bicyclist's) head. Skirt portion 6 in use extends downward to some extent over the sides and the rear of the user's head, preferably such that a distal portion extends below the occipital protuberance of the bicyclist. The skirt portion 6 provides for extension downward of helmet material for protection along the sides and rear of the user's head. Generally, crown portion 4 is at least partially covered by a shell (not shown) of a harder polymeric material shaped and cut to conform to the outer surface of the crown portion 4 of the helmet body 2. The shell can help to stabilize the structure of the helmet body 2 under impact, and improve the protective value and appearance of the helmet.

Figure 23:
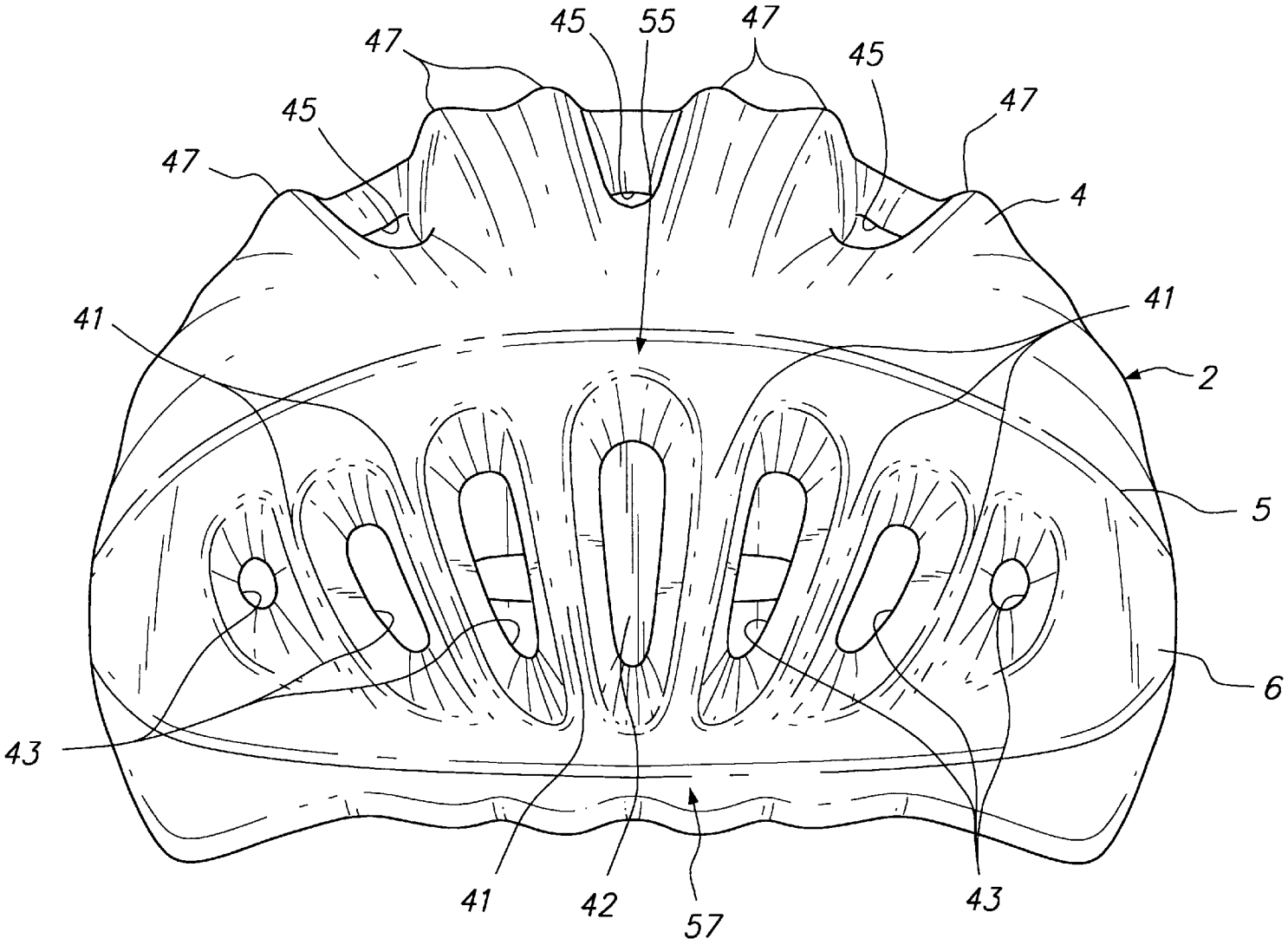
Figure 24:
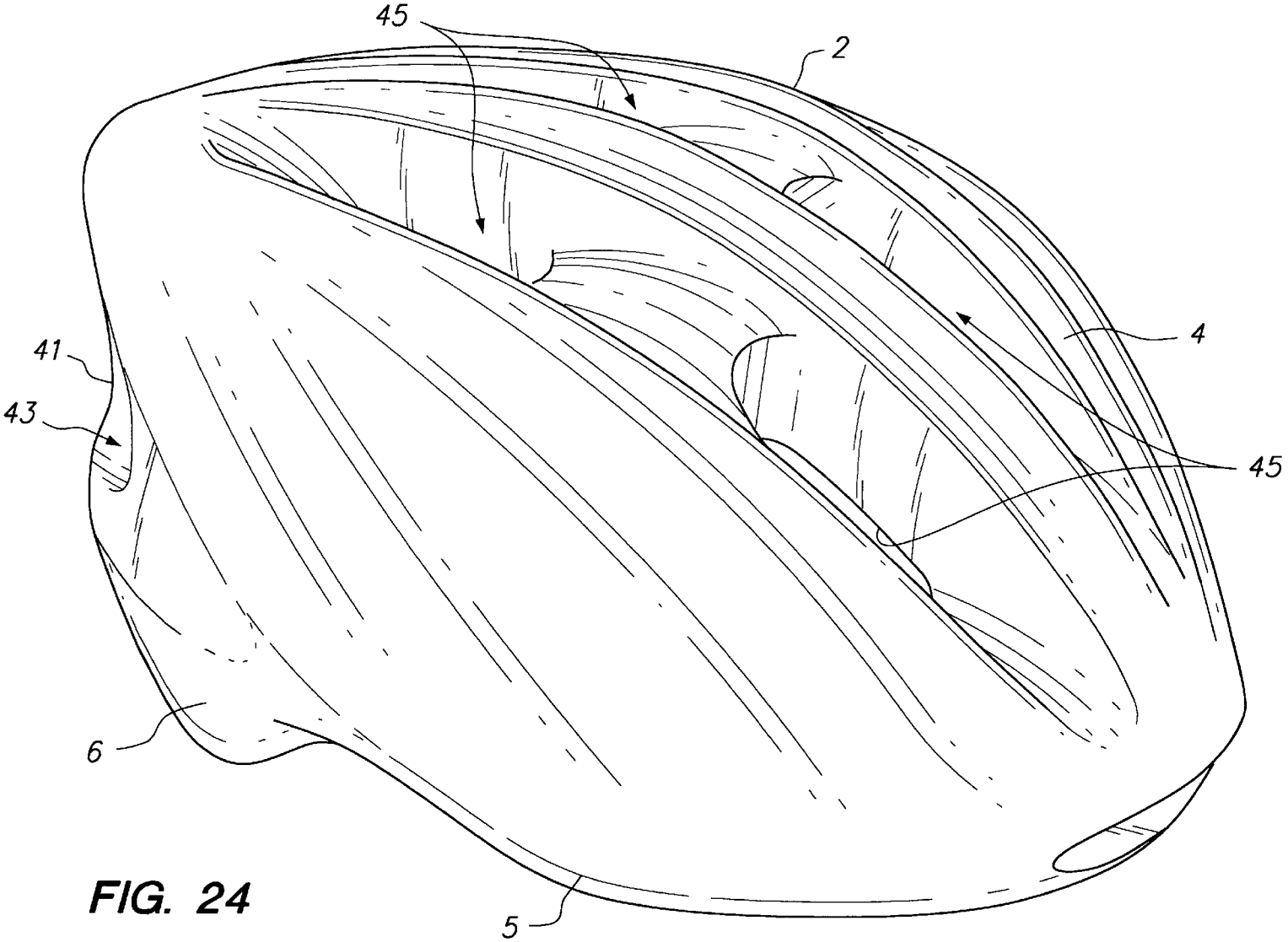
Figure 25:
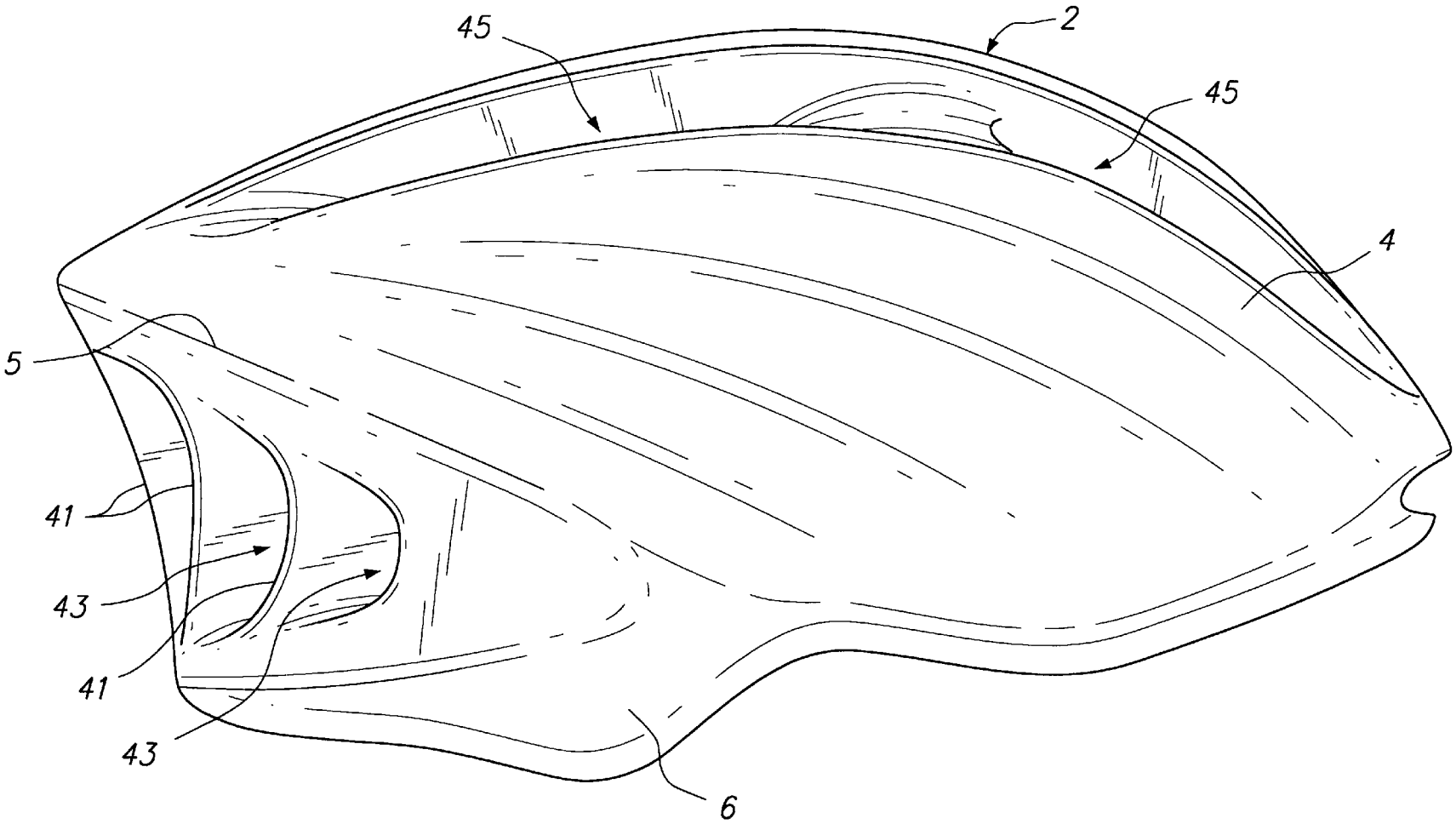
Figure 26:
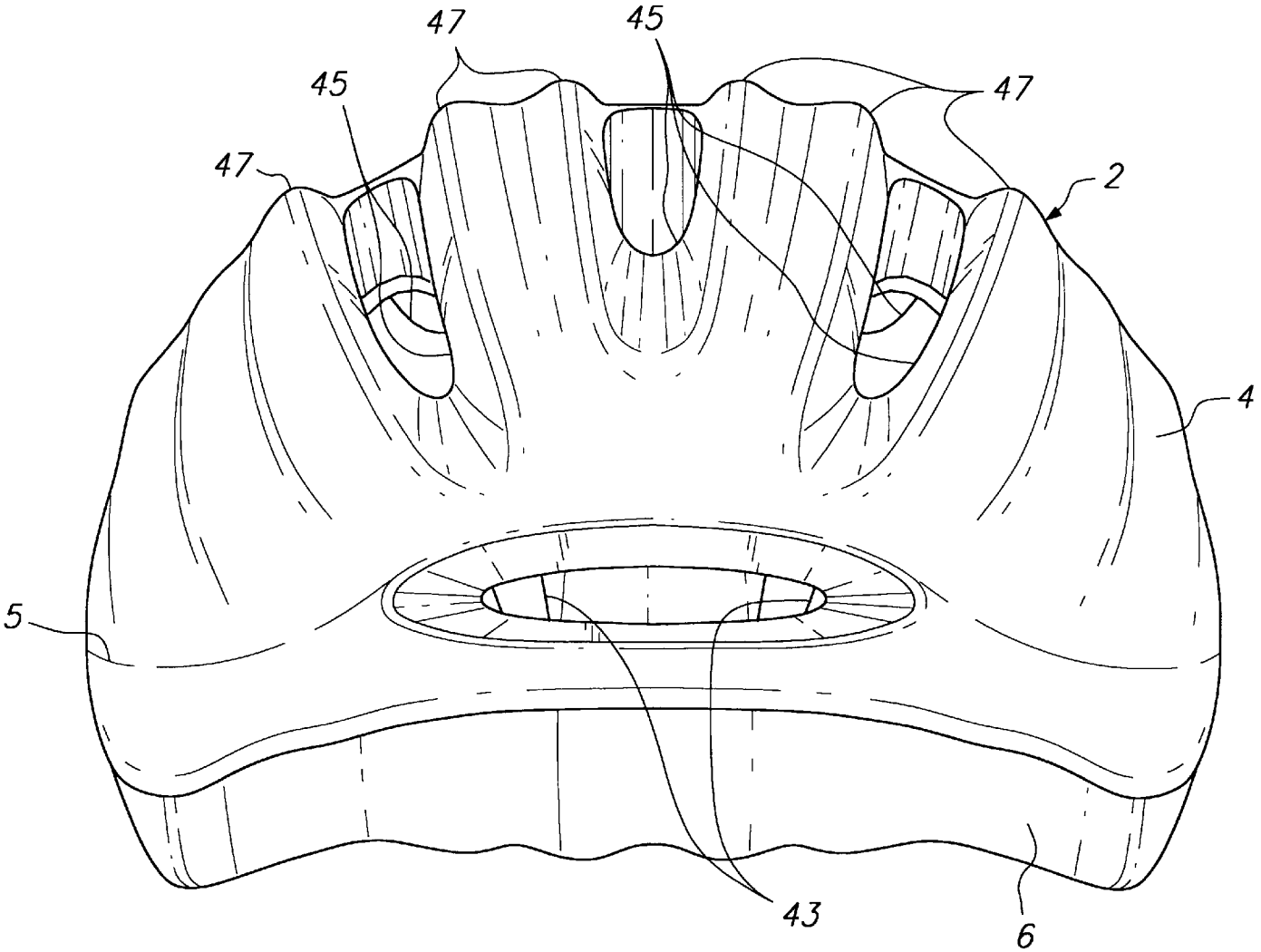
Figure 27:
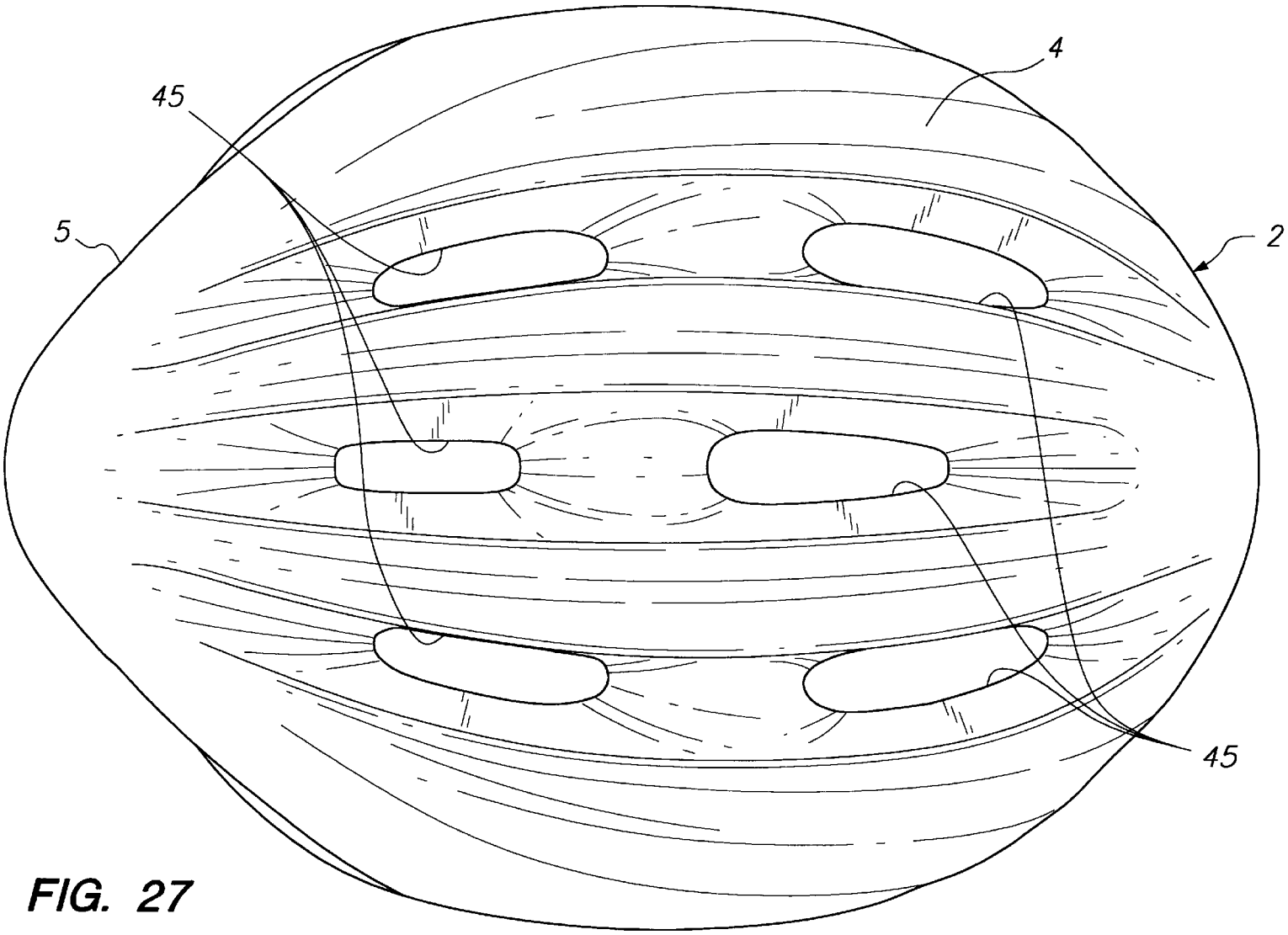
Figure 28:
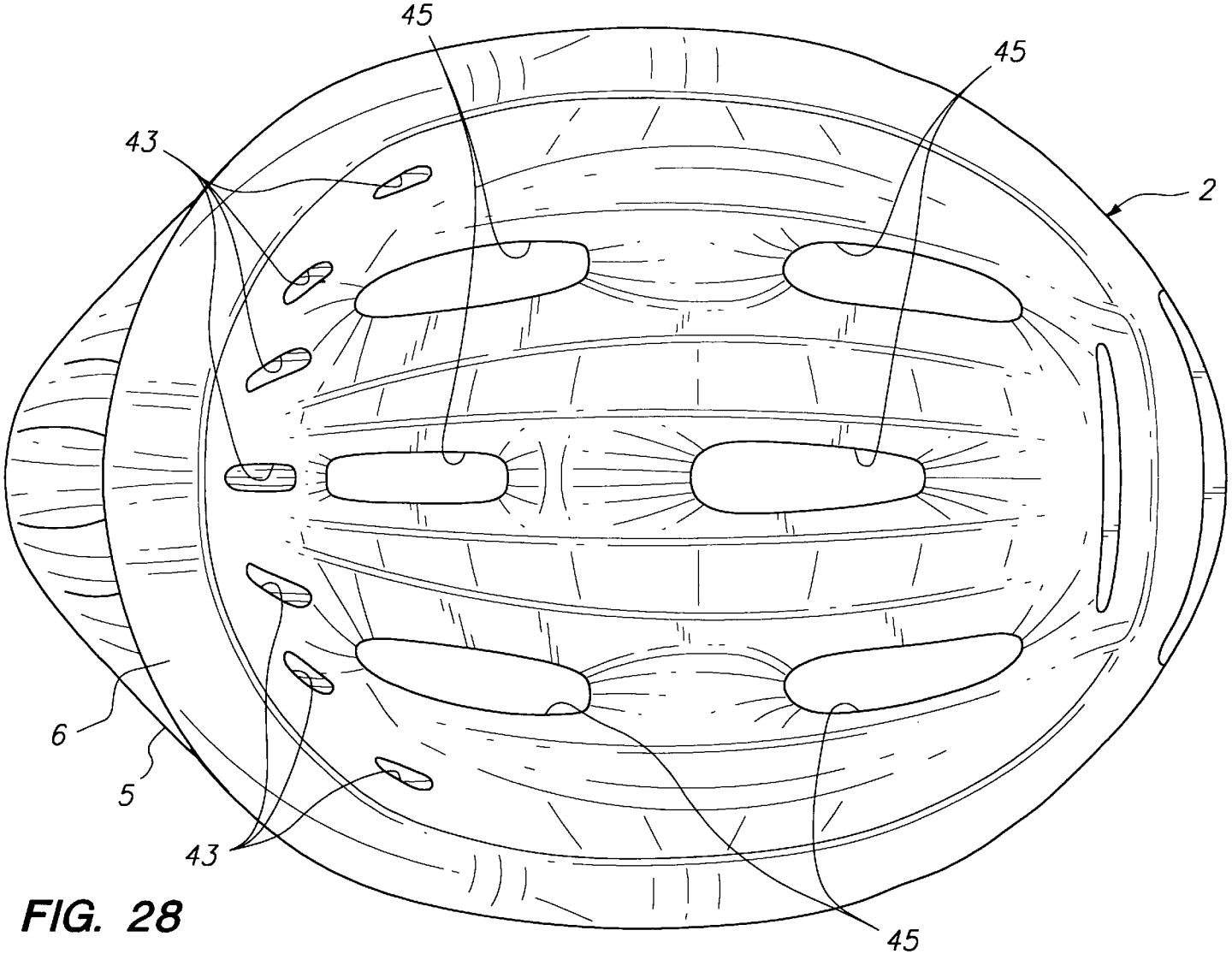

The helmet body 2 according to at least one embodiment of the present invention is provided with at least two generally vertical columns or pillars 41 in the rear skirt portion of the helmet body 2 on either side of the midline or centerline extending front to back of the helmet body 2. Preferably, the columns are substantially vertical but it is within the scope of the invention that the columns be at an angle of about 45° or less from vertical. In a preferred embodiment, the columns 41 are configured so as to provide structural integrity to the helmet while providing ventilation through the openings 43 adjacent to the columns 41, but as shown in FIG. 23 there does not have to be an opening between the columns, the columns can extend substantially through the thickness of the helmet body and a support member (or web) 42 extending generally transverse between all or some of the columns can connect the columns. The columns 41 and the openings 43 are located in the most rearward portion of the helmet behind the user's ears and generally near the occipital region of the user's head, preferably the columns have at least a substantial portion extending below the rearward most point or the imaginary curve 5 of the helmet.

Generally, the columns 41 extend from the upper rim portion 55 of the skirt portion 6 at the imaginary curve 5 to the lower rim portion 57 of the skirt portion 6. With this configuration, substantially large openings 43 and/or a large number of openings 43 can be provided in the most rearward portion of the helmet body 2 in the skirt portion 6 while maintaining the structural integrity of the helmet body 2. The columns can be a variety of widths (i.e., thick) depending on the strength desired. The depth of each column is generally from the outside surface to the inside surface of the helmet body, but as can be seen generally in the rear perspective views, the depth along the height of each column can vary. For example, the mid-section of the column can have less depth than the top and bottom of the column. Likewise, the depth at the top of the column can be greater or less than the depth at the mid-section or at the bottom of the column. In preferred embodiments, the columns 41 are thicker where they intersect the inside surface of the rear helmet body wall and thinner at the outside surface of the helmet body.

Figure 1:
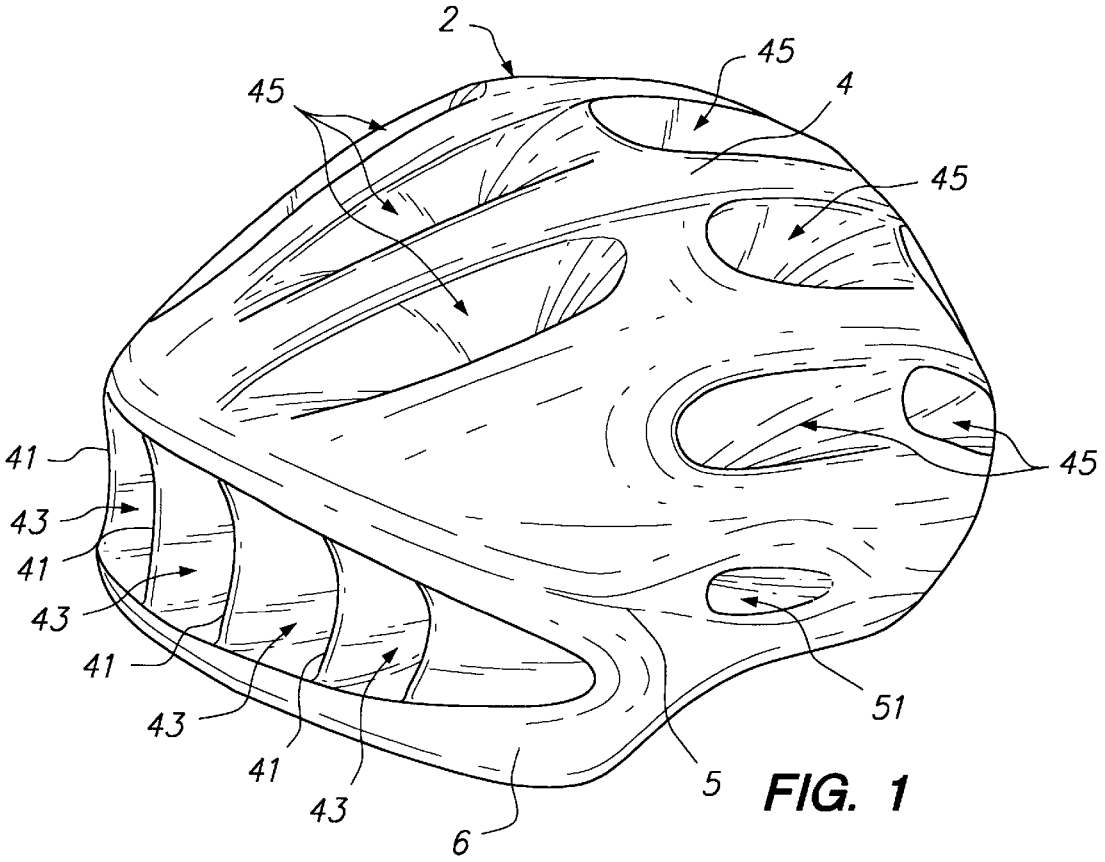
FIG. 1 is a perspective view as seen from the right and rear of a first embodiment of a helmet body in accordance with the present invention.
Figure 2:
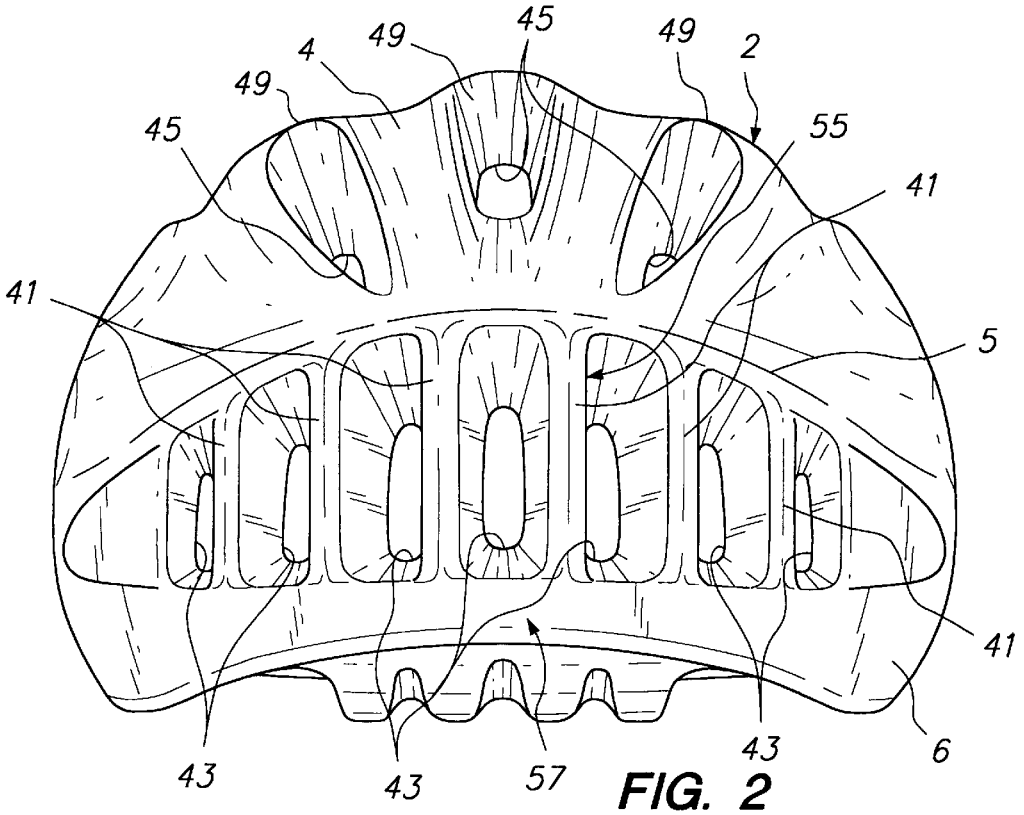
FIG. 2 is a rear elevational view of the helmet body of FIG. 1.
Figure 3:
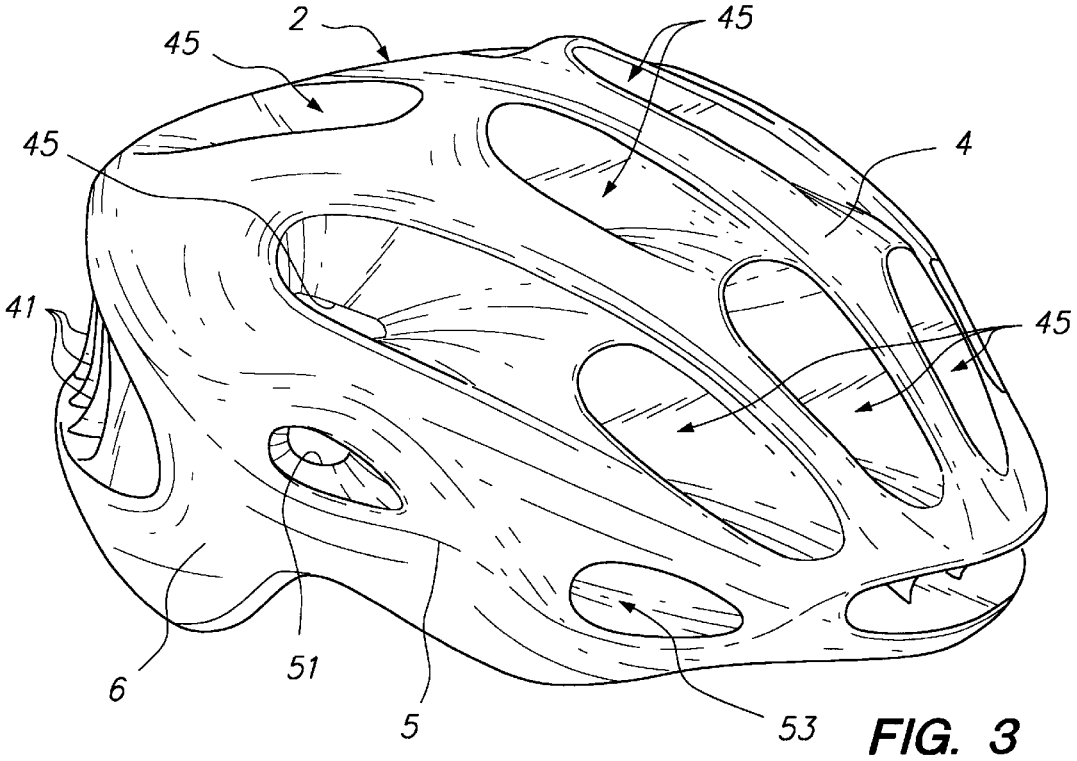
FIG. 3 is a perspective view as seen from the front and right of the helmet body of FIG. 1.
Figure 9:
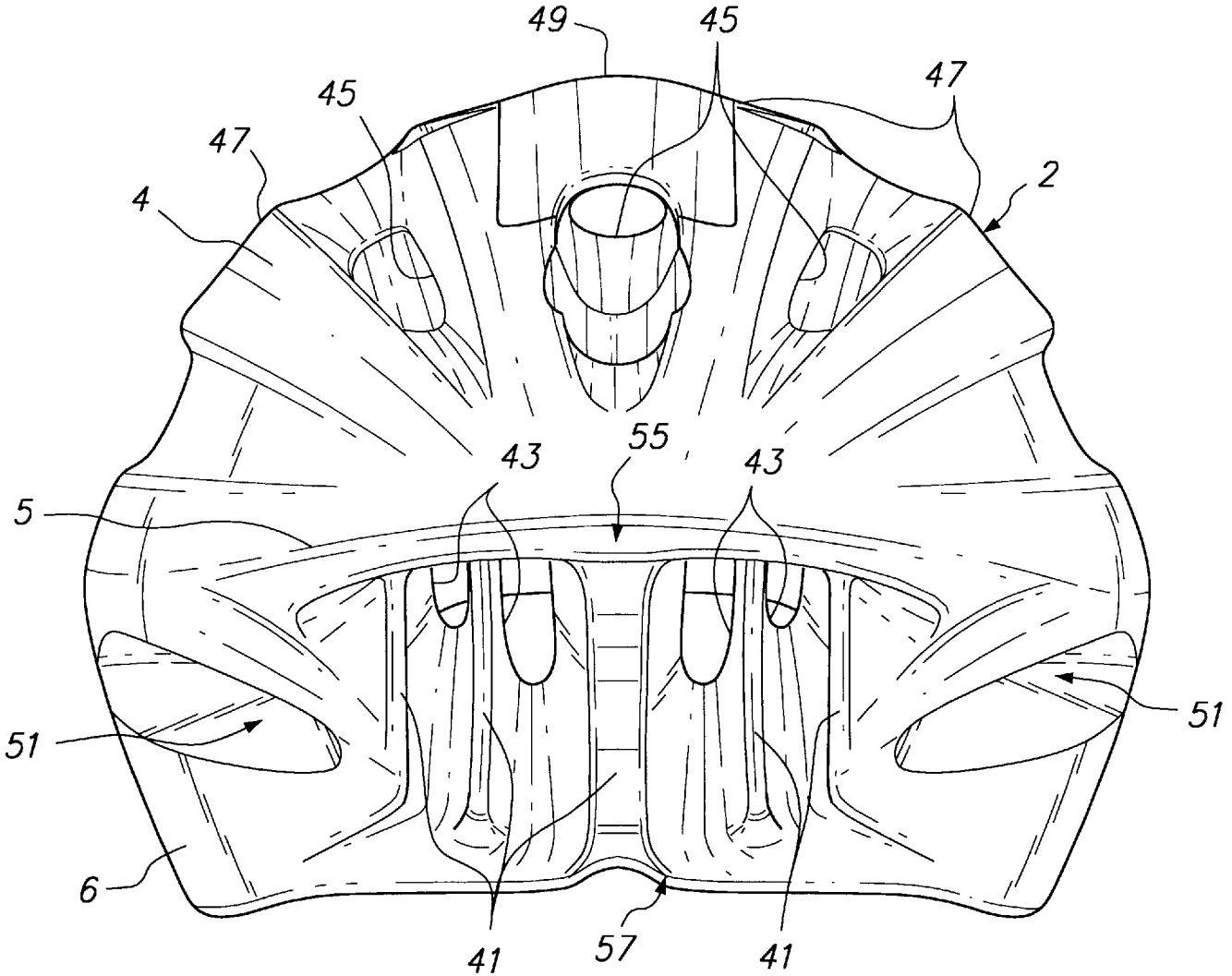
Figure 10:
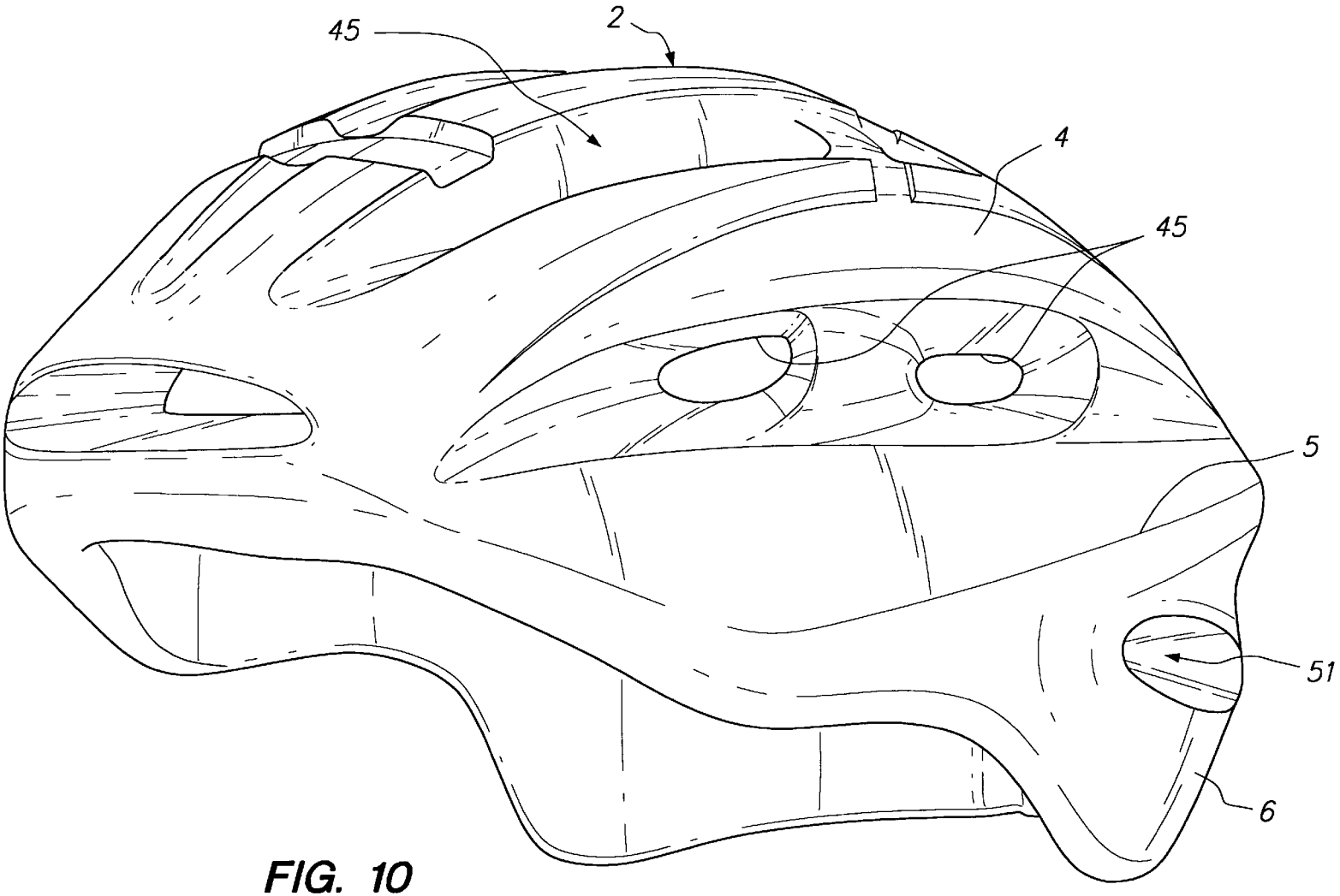
Figure 11:
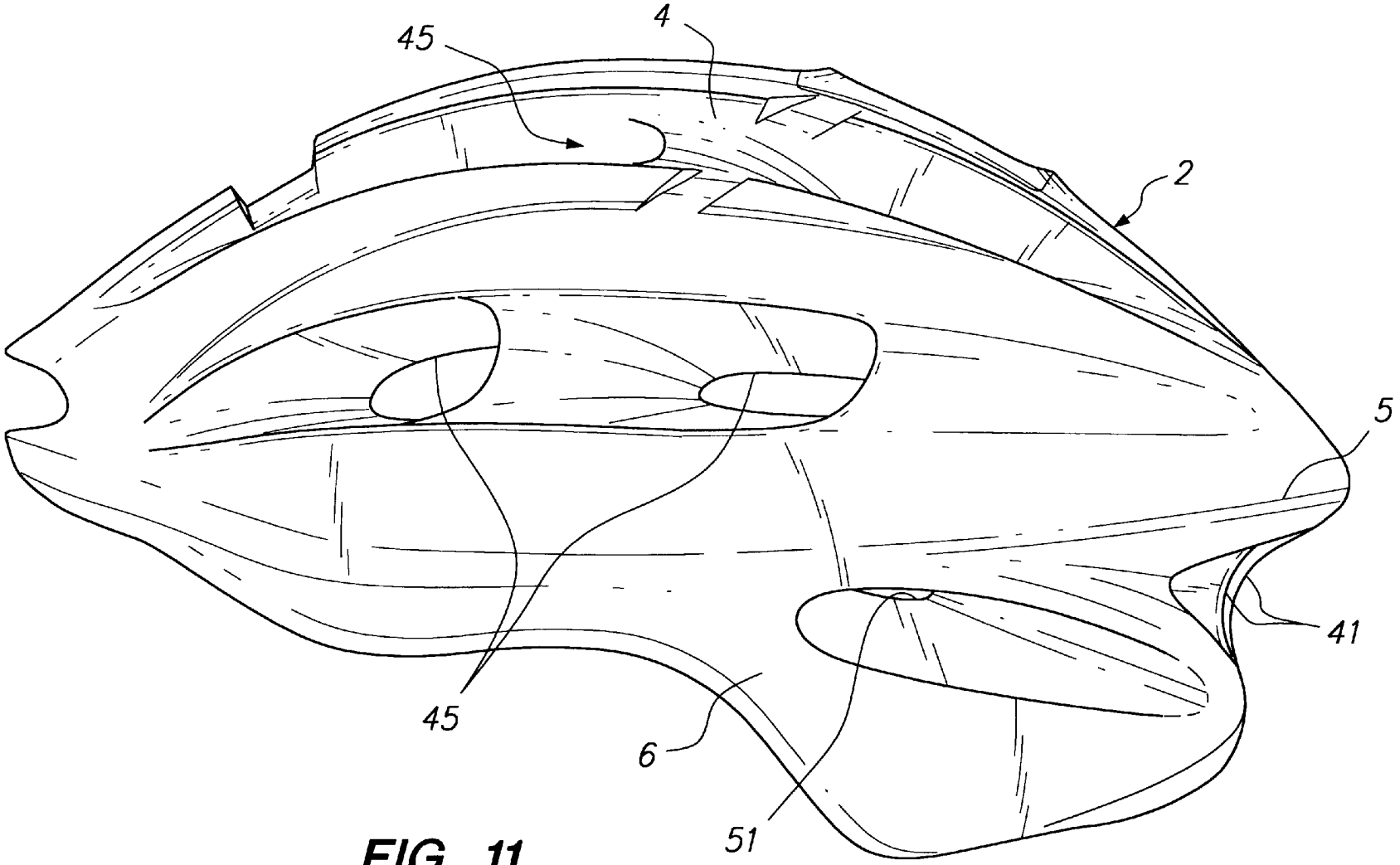
Figure 12:
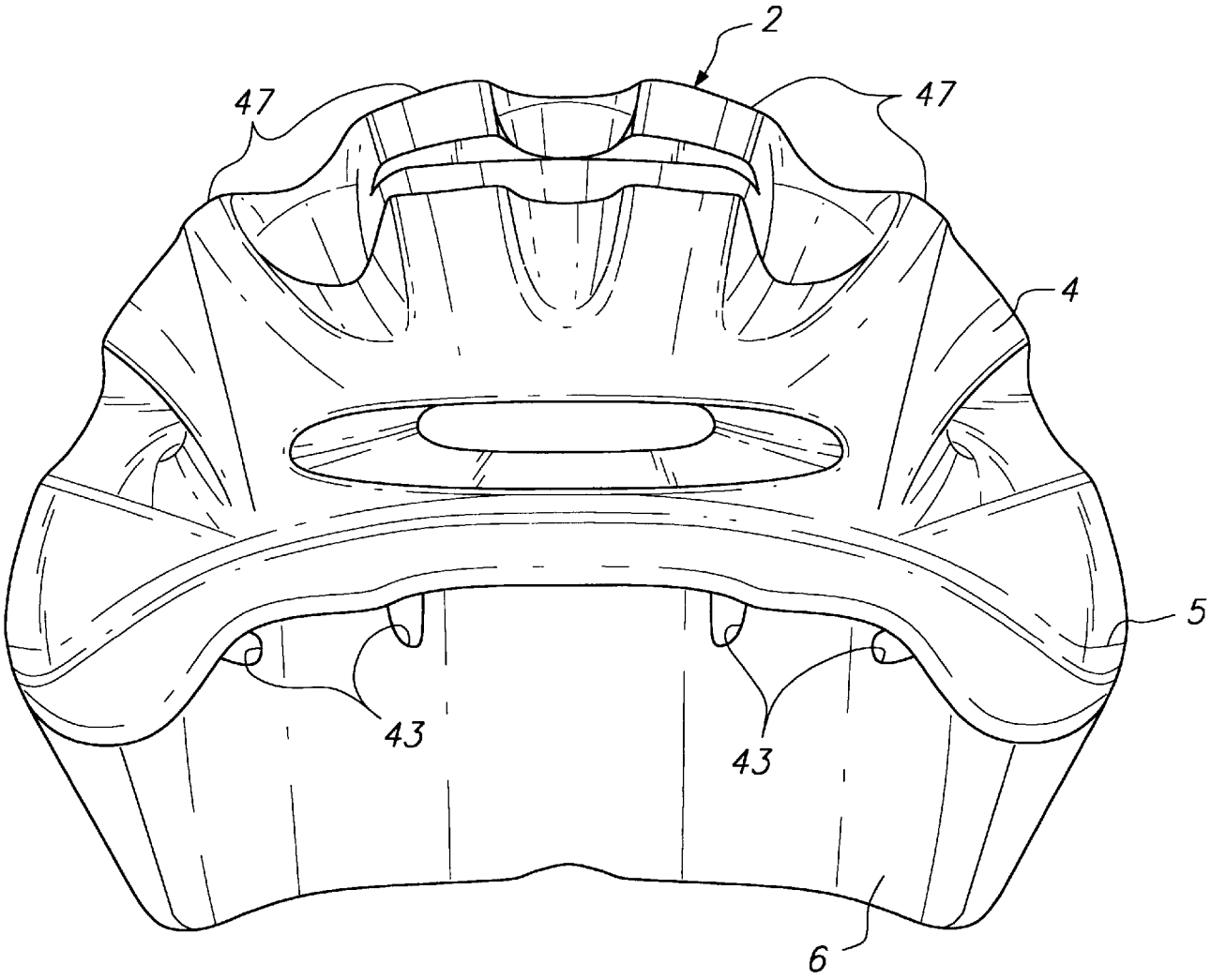
Figure 13:
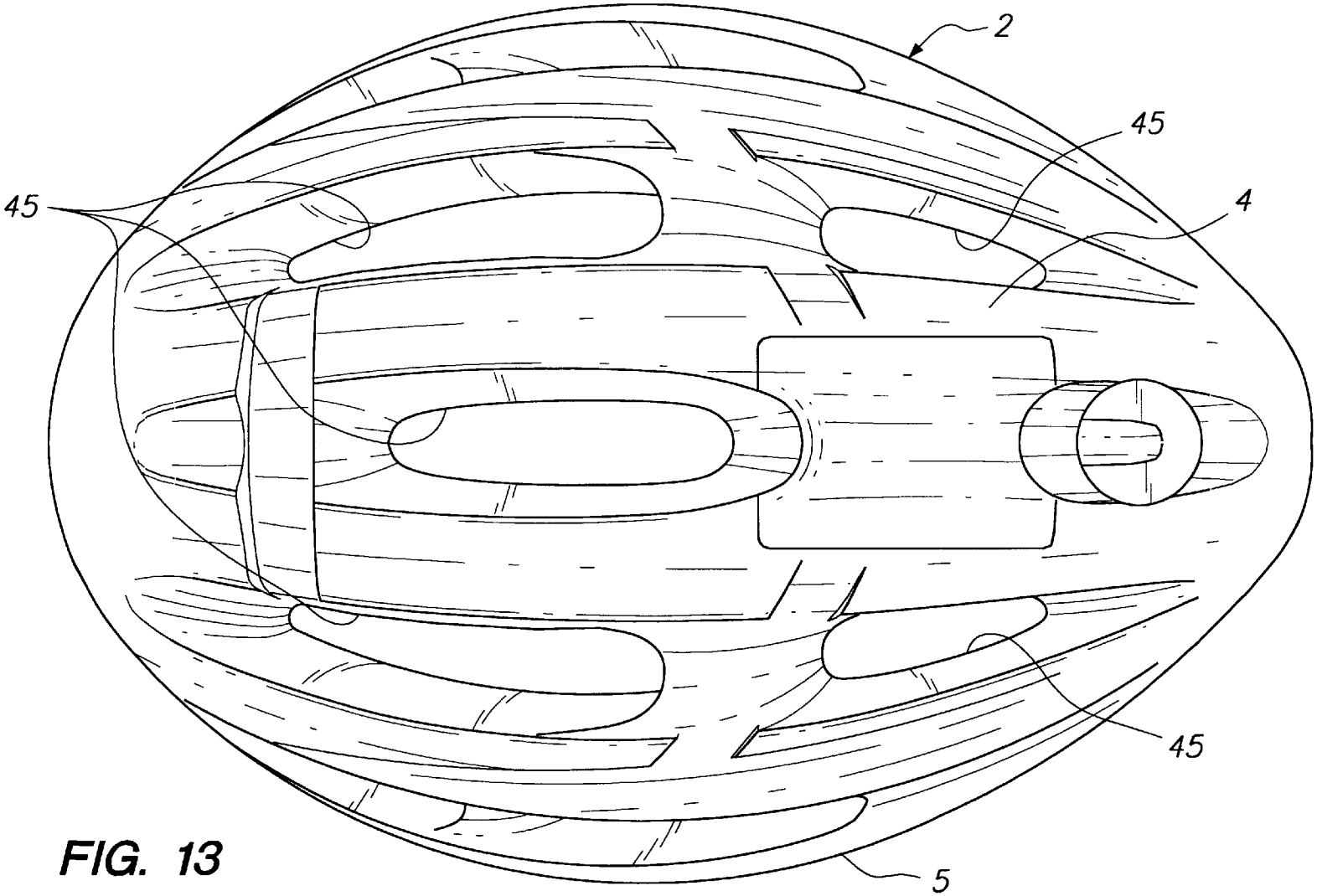
Figure 14:
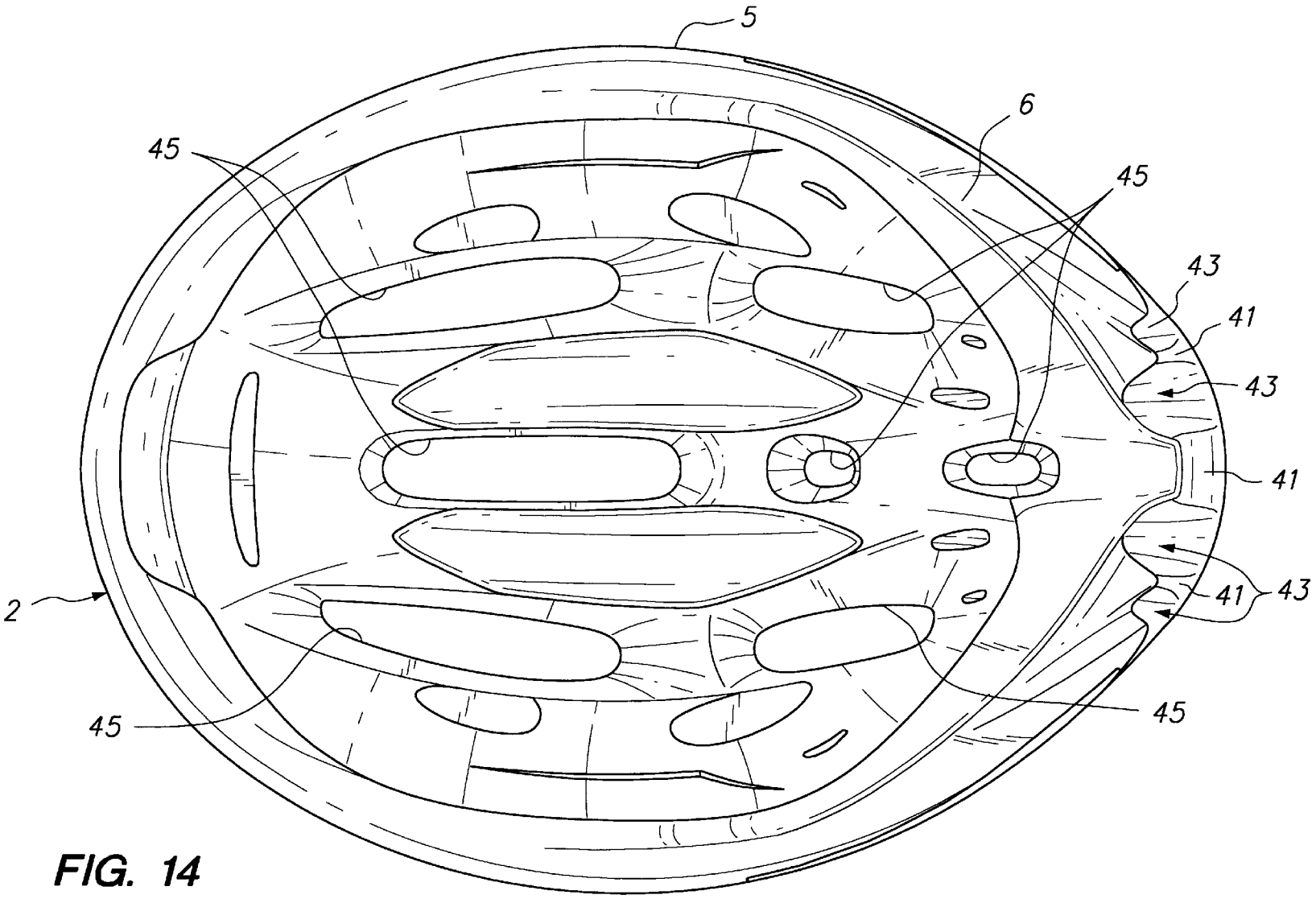
Figure 15:
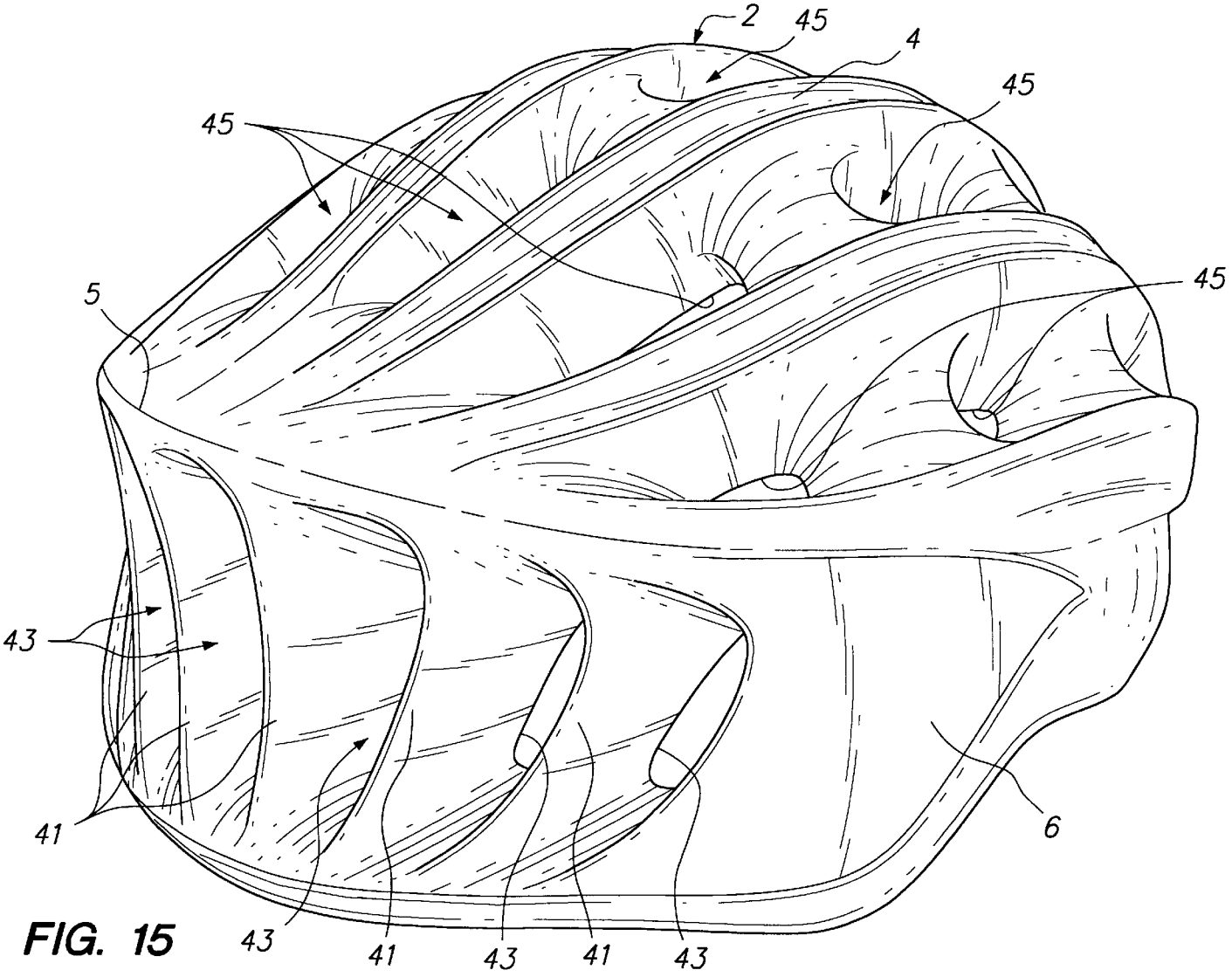
FIGS. 15–21 are a third embodiment of a helmet body in accordance with the present invention.
Figure 16:
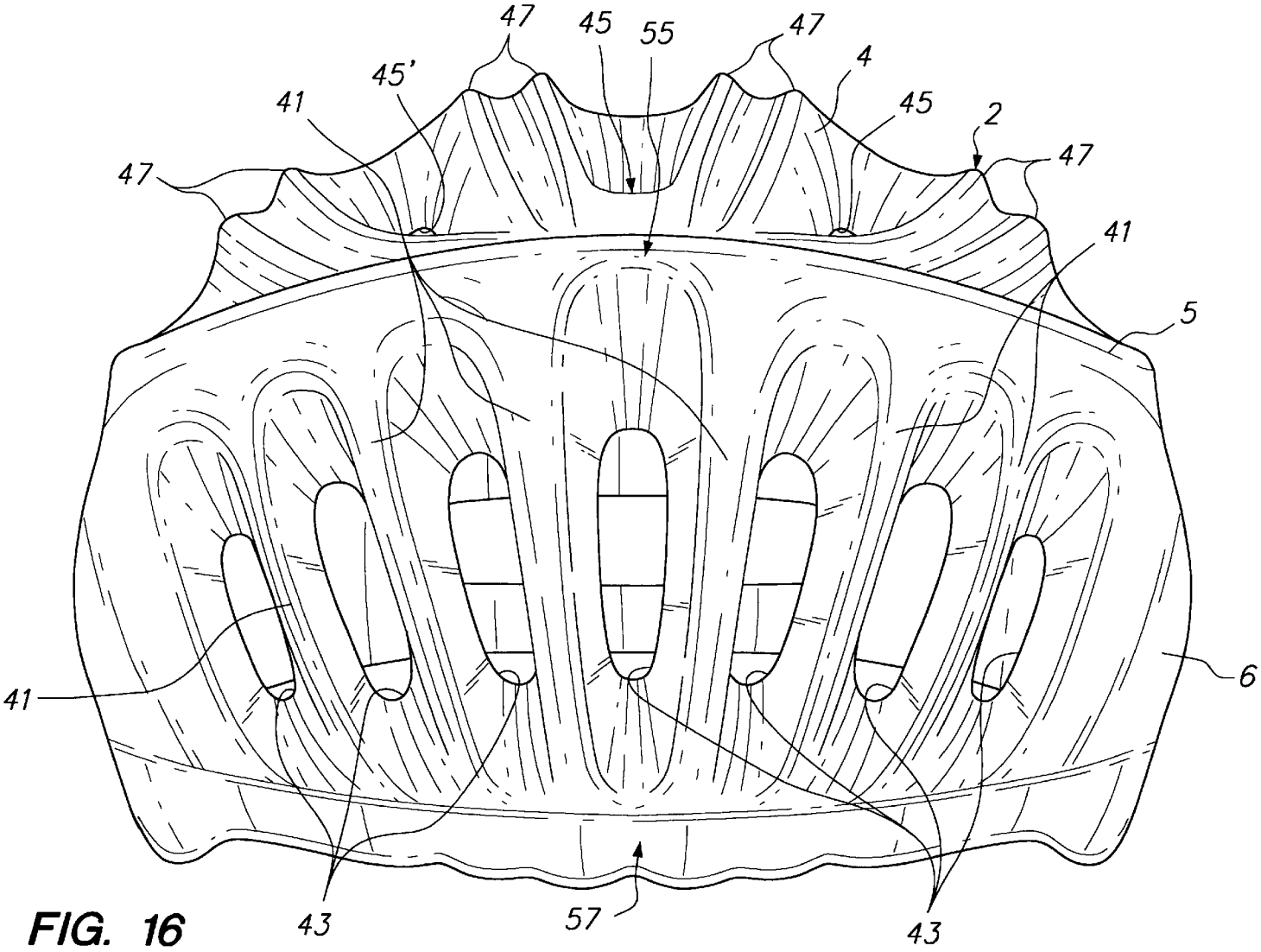
Figure 17:
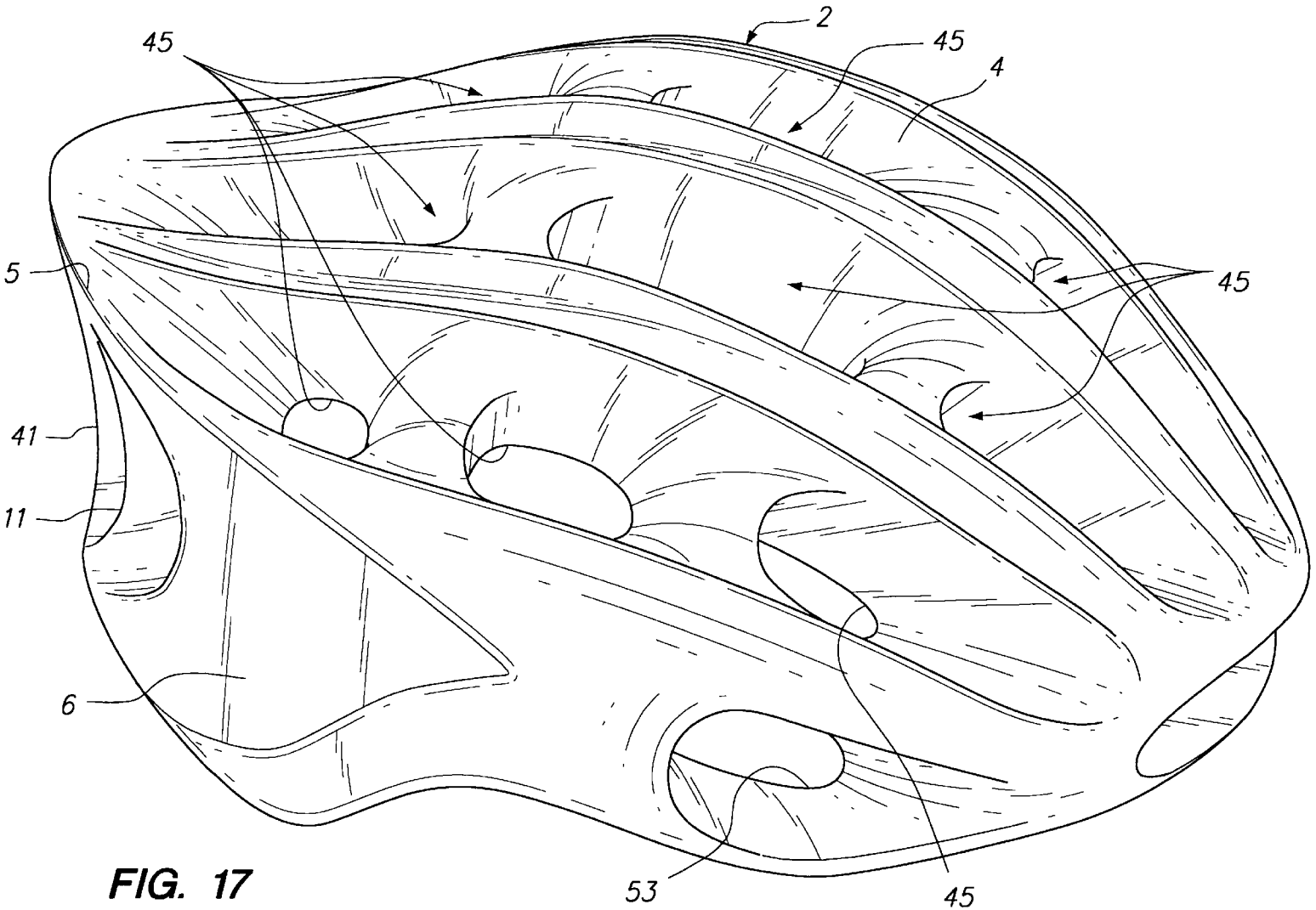
Figure 18:
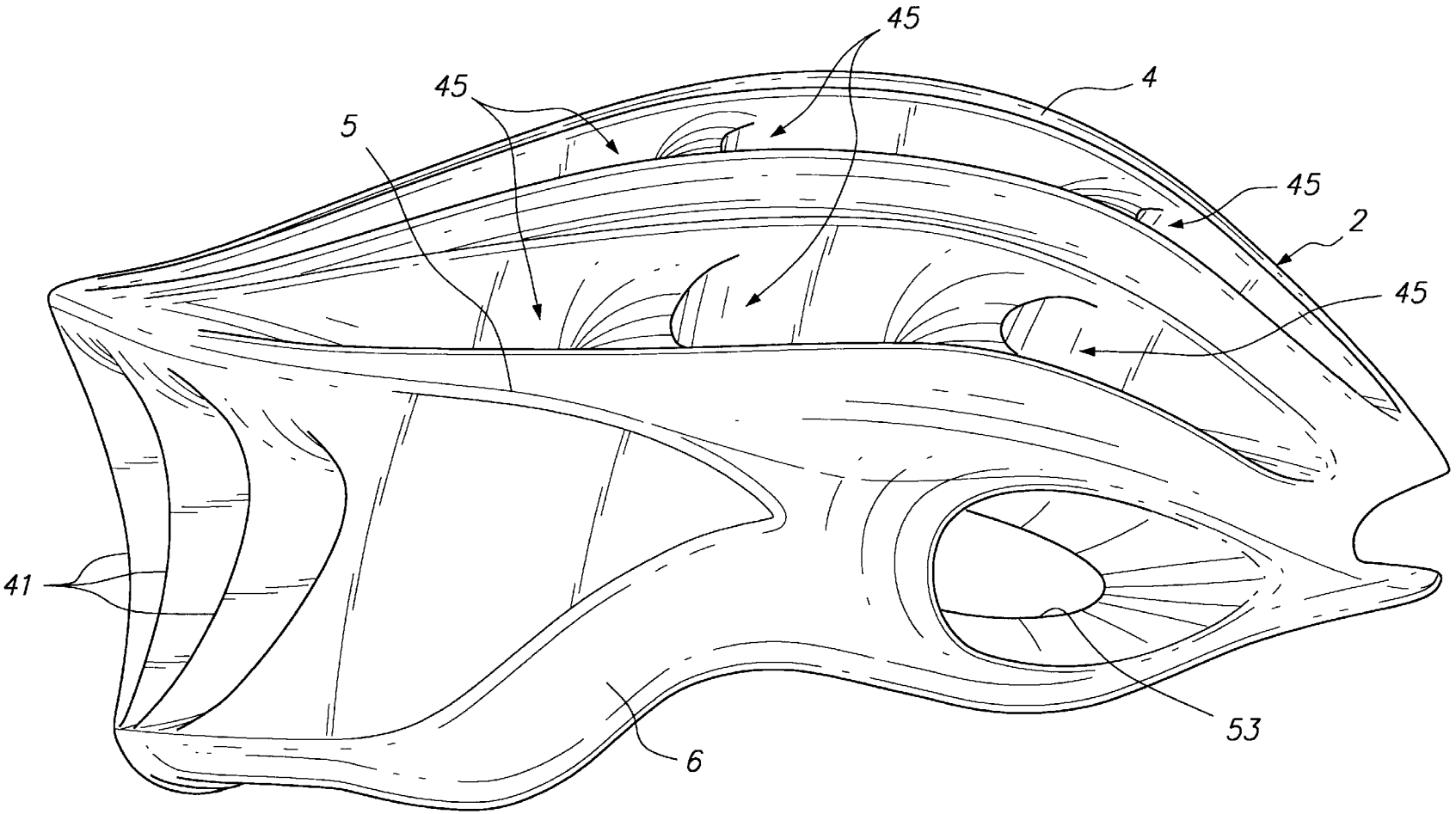
Figure 19:
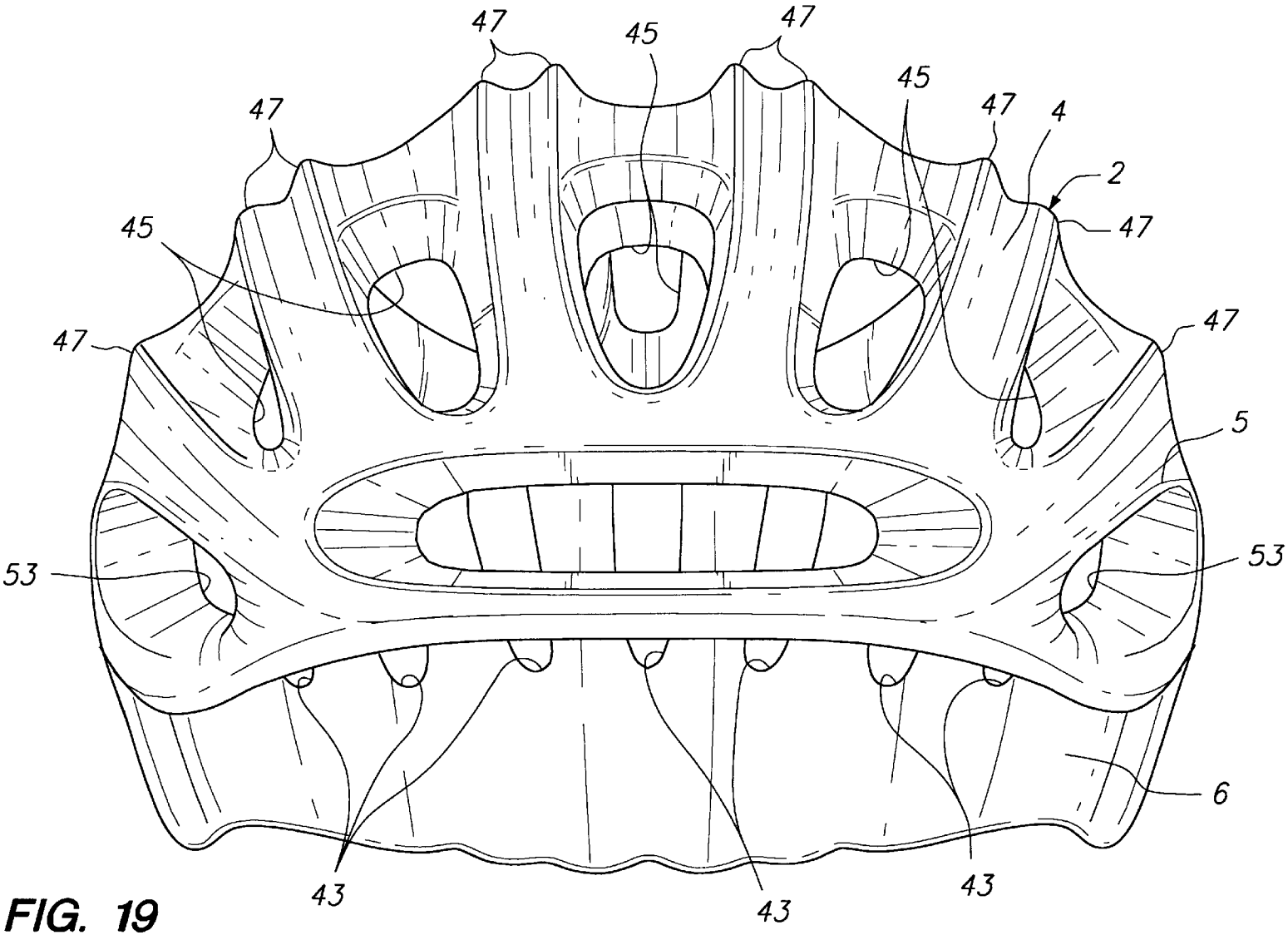
Figure 20:
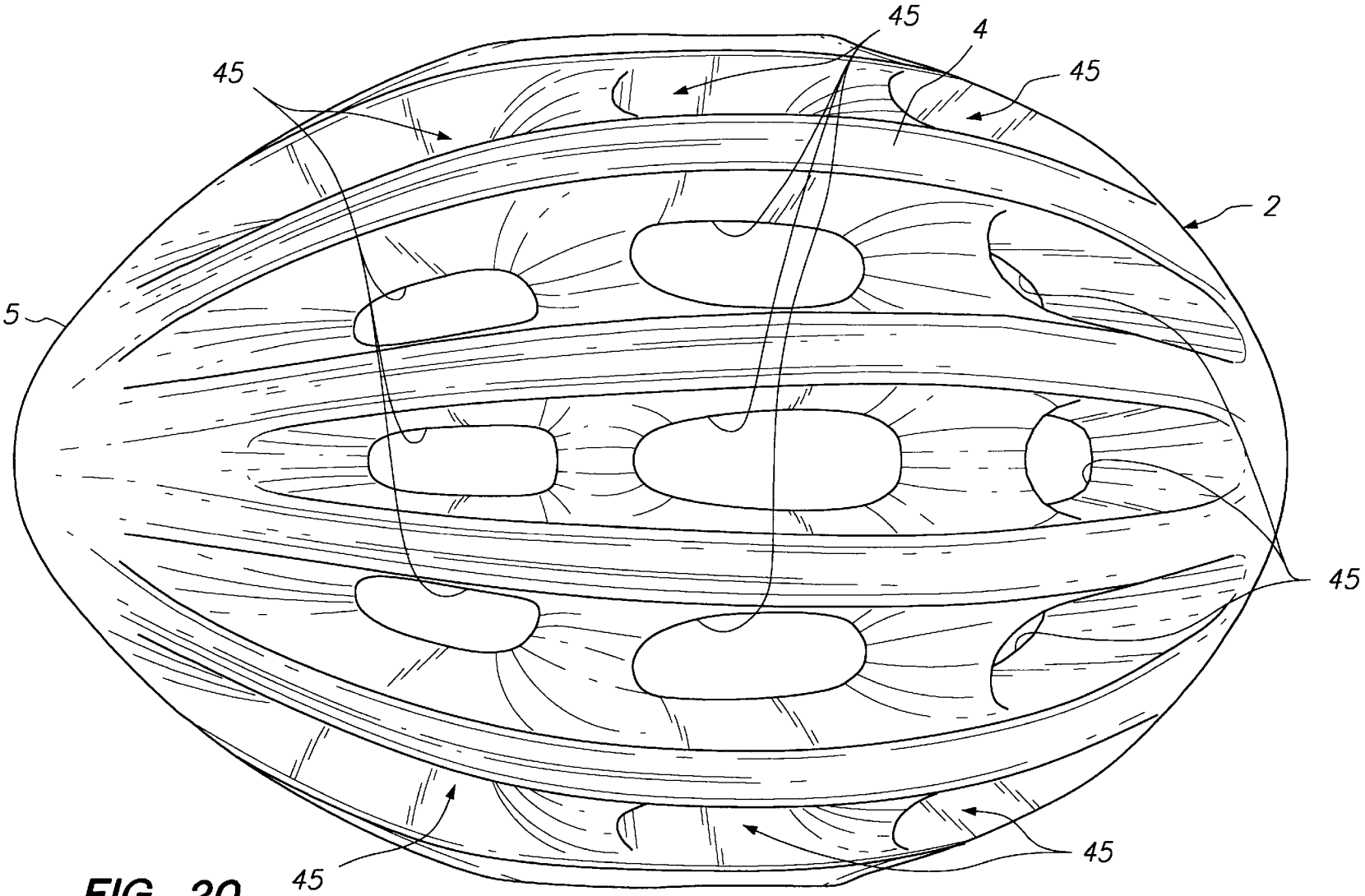
Figure 21:
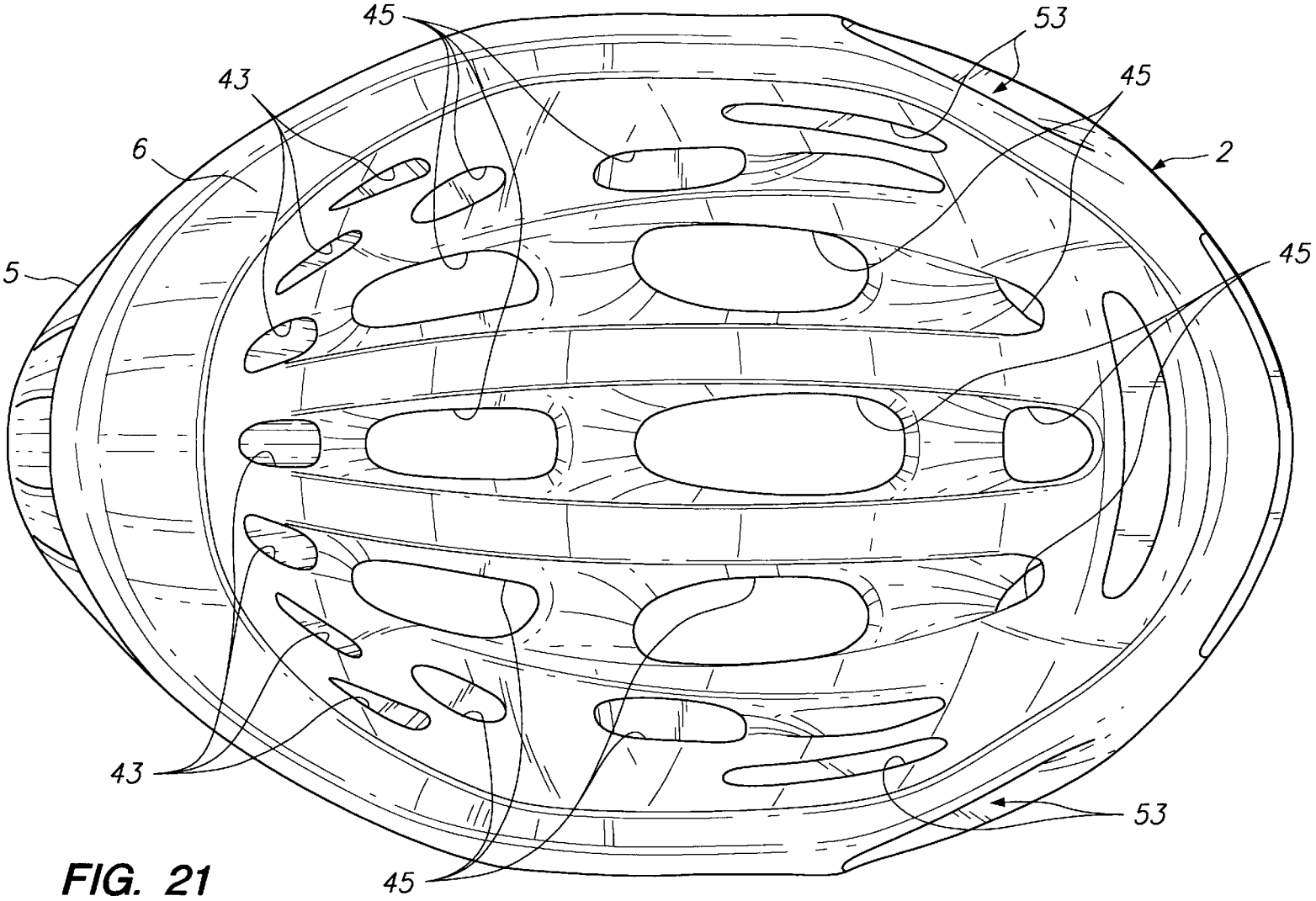
Figure 22:
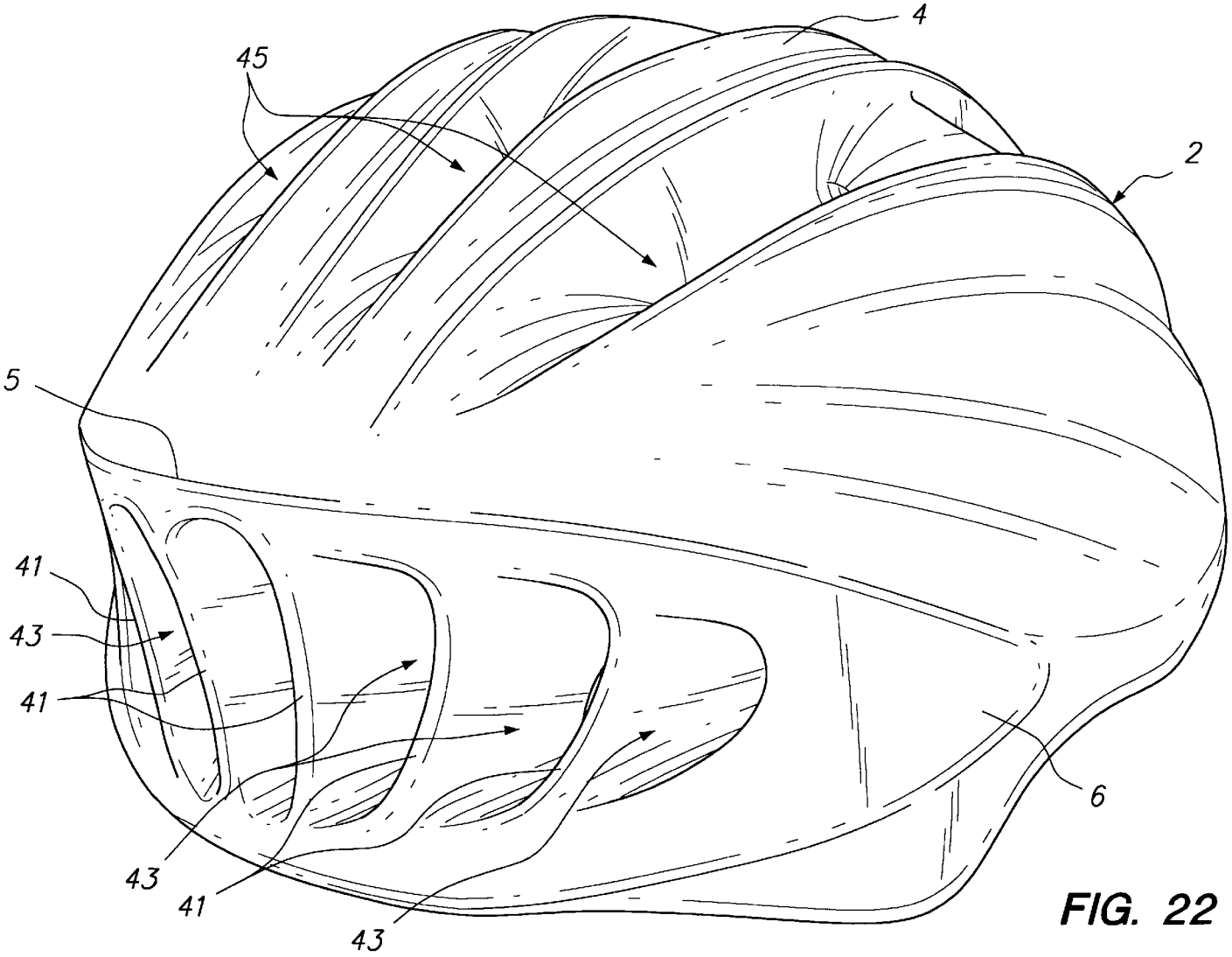
FIGS. 22–28 are a fourth embodiment of a helmet body in accordance with the present invention.

The number and arrangement of the columns 41 can be altered within the scope of the present invention. For example, the illustrative embodiments have either five or six columns 41 with between four and seven openings 43 adjacent thereto through the rear portion of the helmet body 2. It is within the scope of the invention that the number of columns can be any number from two and above, preferably from four and above. In addition, the columns can be spaced on either side of the center line or midline extending front to back along the helmet body as shown in FIGS. 2, 16, and 23, or a first column can be along the midline with a plurality of columns and openings on either side of the center column as shown in FIG. 9. Likewise, fewer valleys may be provided across the crown portion 4 than are shown and fewer vents may be provided in each valley than are shown. In addition, more valleys can be provided than are shown and more vents may be provided in each valley than are shown.

Figure 5:
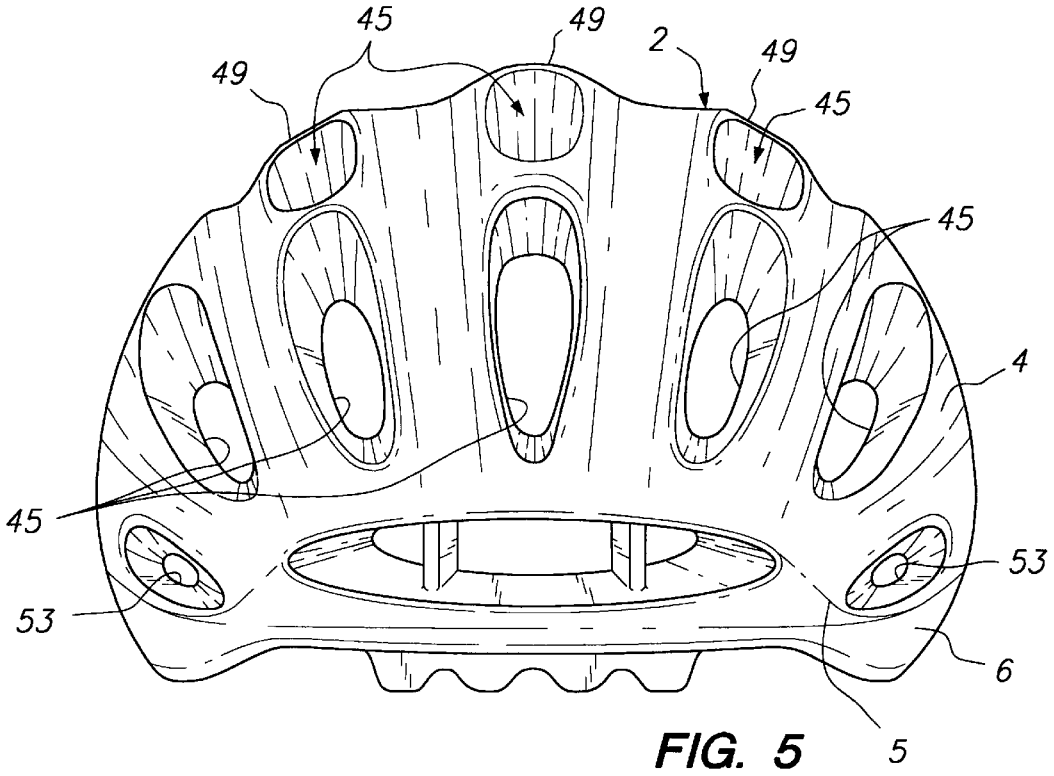
FIG. 5 is a front elevational view of the helmet body of FIG. 1.

In preferred embodiments, the helmet body 2 is provided with vents 45 over the top of the crown portion 4 in addition to the openings 43 adjacent to the columns 41 in the rear portion of the helmet body 2. Preferably, such top vents 45 are arranged in lengthwise rows and include in each row at least a more forward vent and a more rearward vent. The number and size of the top vents 45 can, without unduly compromising the strength of the helmet, be increased by constructing the crown portion 4 of the helmet body 2 as a series of ridges 47 (for example, FIGS. 9, 12, 16, 19, 23 and 26) and situating the top vents 45 in the valleys formed between the ridges 47. Preferably, greater strength is obtained by making each valley shallower between the vents. That is by providing some considerable thickness of the helmet body material between the vents. Similarly, ridges 49 can be constructed in the crown portion 4 with the top vents 45 situated on the thickened ridges 49 (for example, FIGS. 2, 5, and 9). Vents 51 can be provided generally along the side portion of the helmet body 2 rearward, above and behind the wearer's ear as well as vents 53 can be provided generally along the side portion of the helmet body 2 forward, above and in front of the user's ear. In some embodiments, for example the second and third, the vents 51 and/or 53 are located below phantom line 5.

Figure 4:
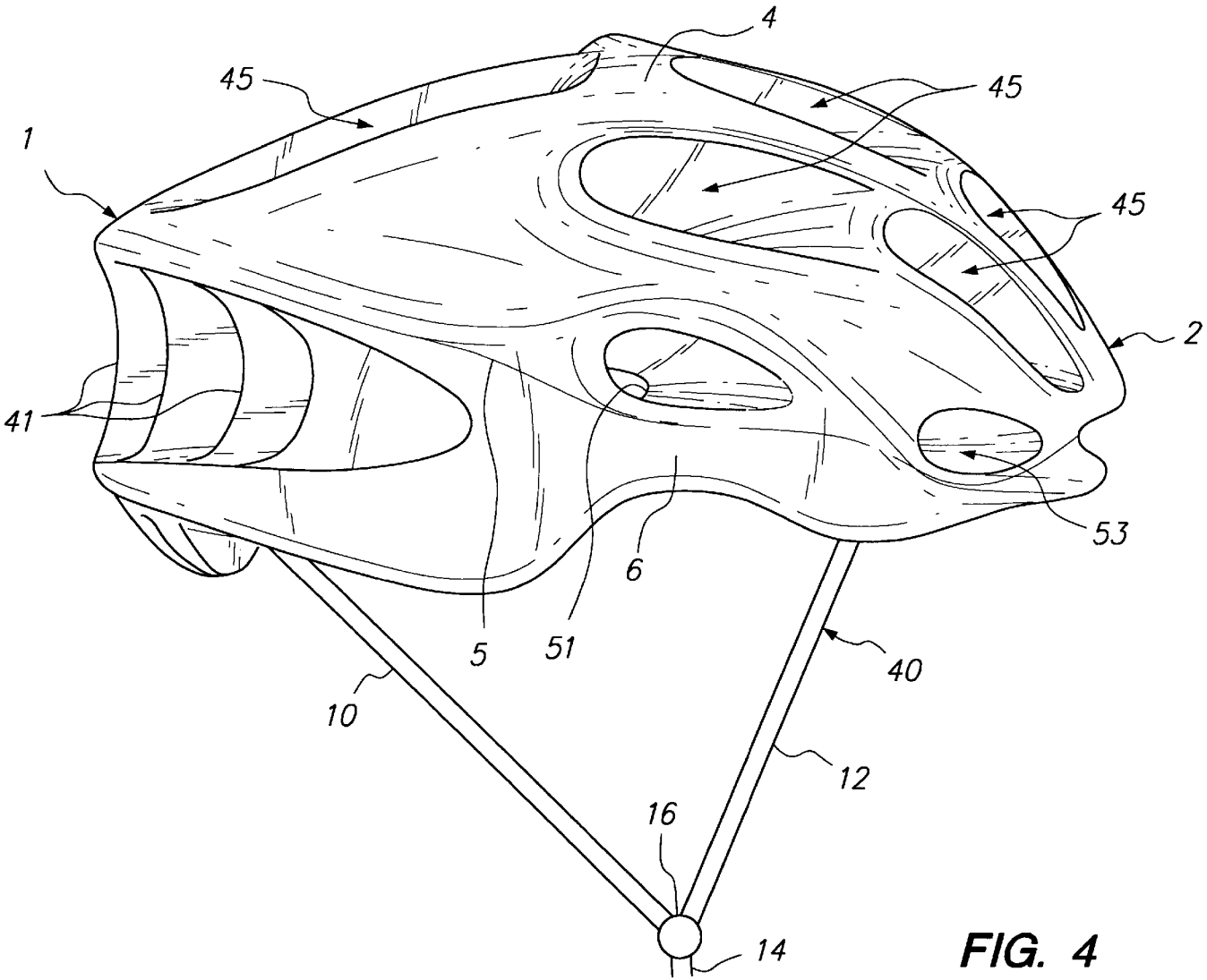
FIG. 4 is a right side elevational view of the helmet body of FIG. 1.
Figure 6:
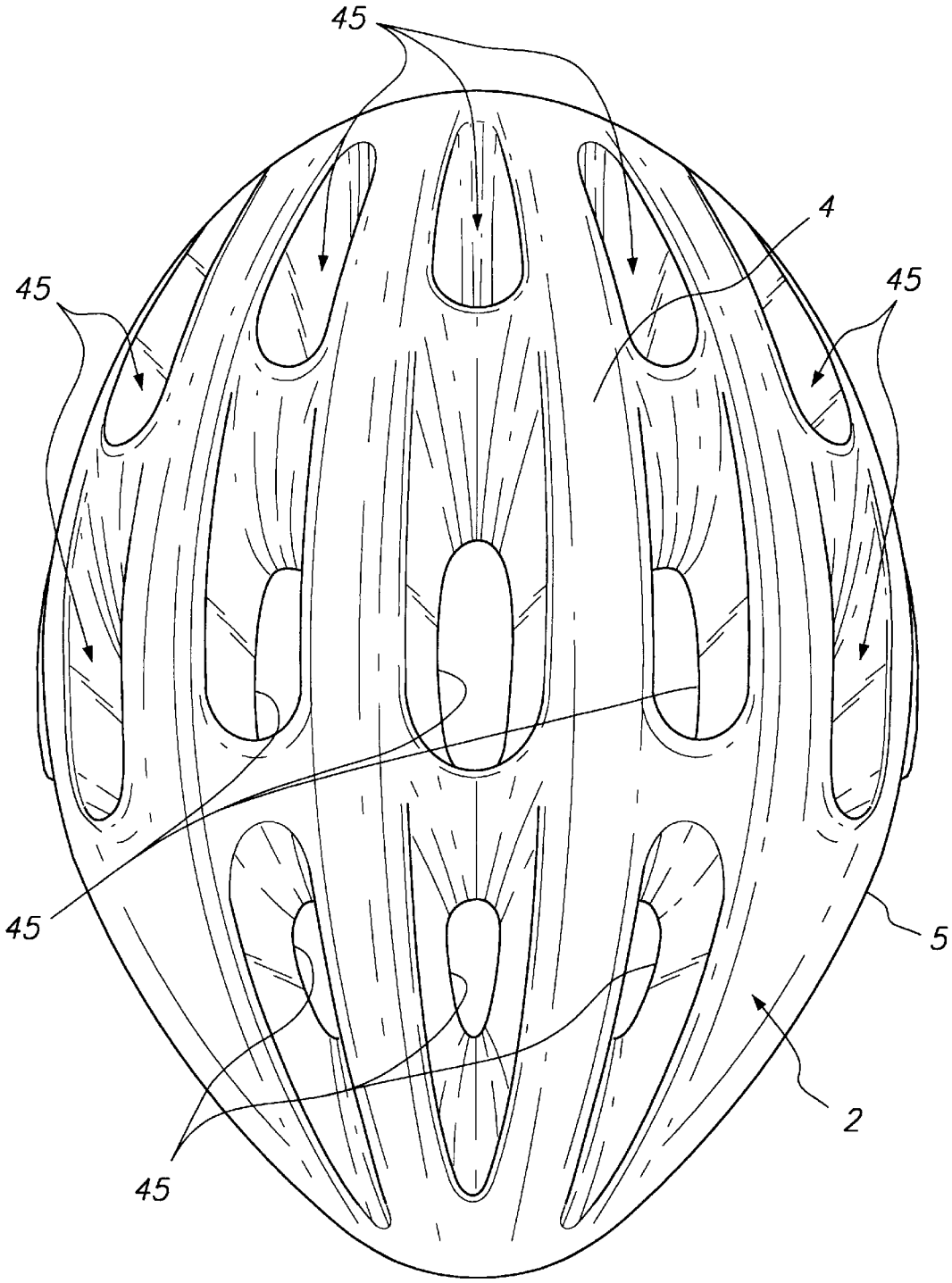
FIG. 6 is a top plan view of the helmet body of FIG. 1.
Figure 7:
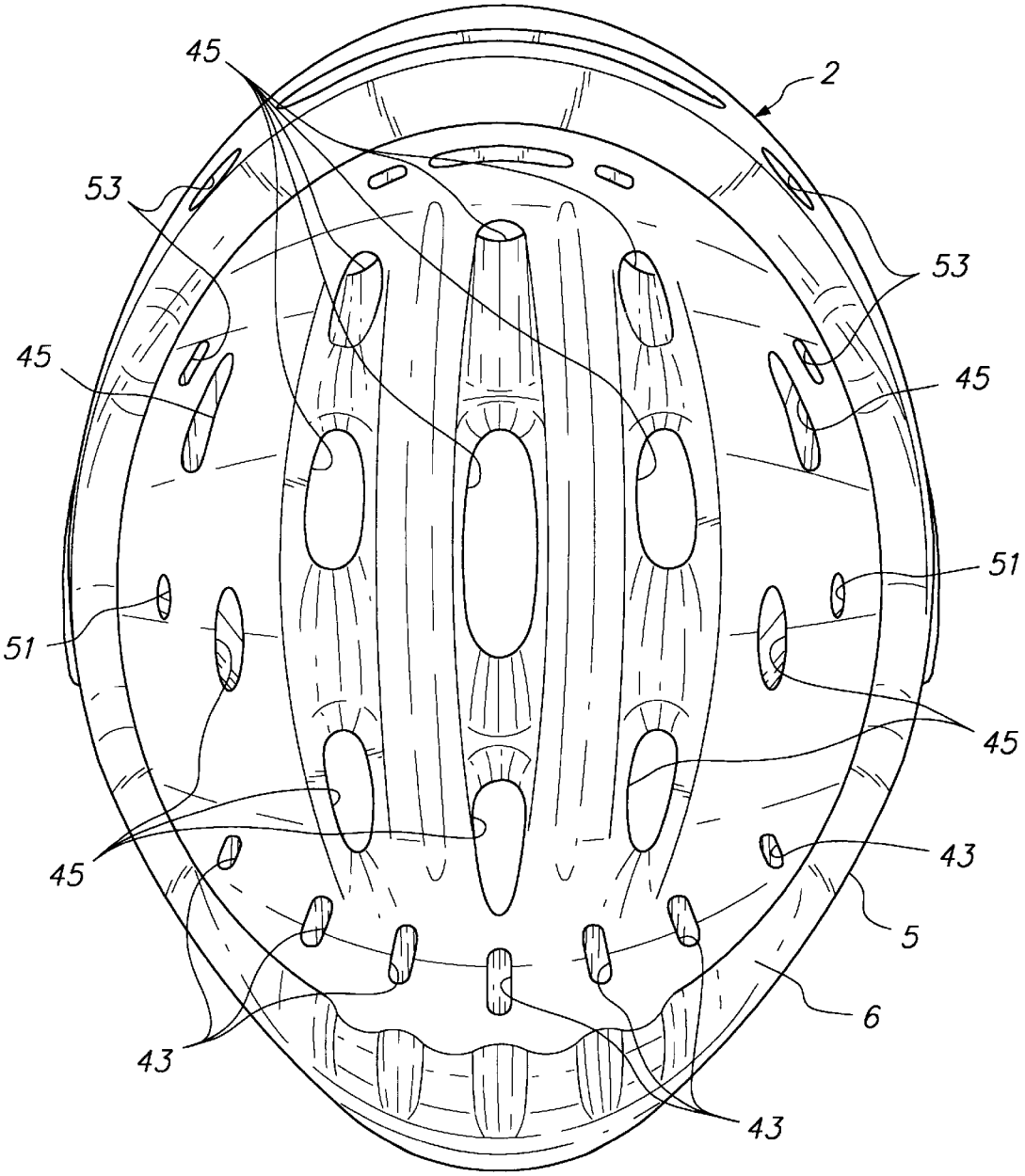
FIG. 7 is a bottom plan view of the helmet body of FIG. 1.
Figure 8:
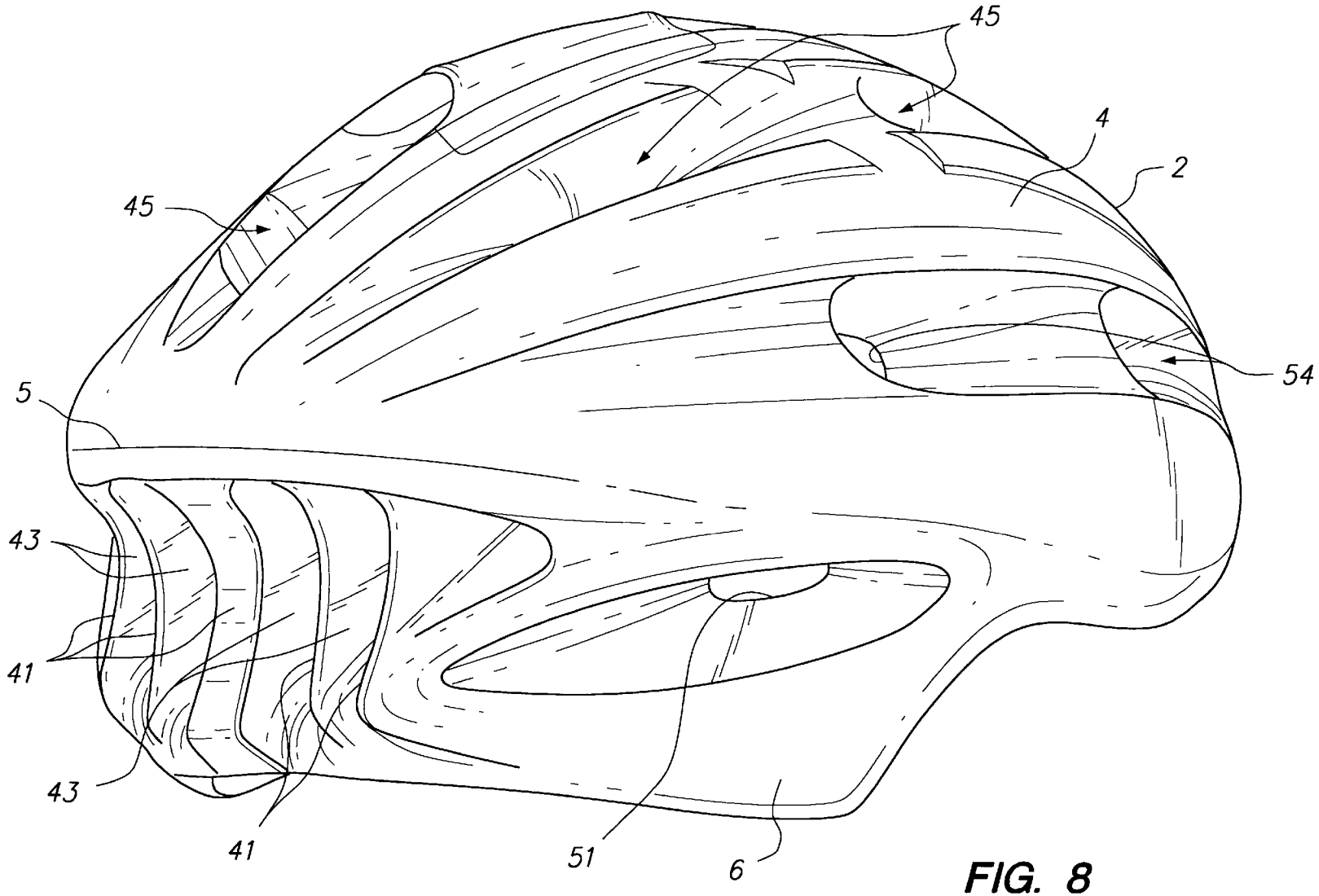
FIGS. 8–14 are a second embodiment of a helmet body in accordance with the present invention.

With reference to FIG. 4, bicycling helmet 1 includes helmet body 2 and retention system 40. All of the embodiments generally will have a retention system, but the retention system is only shown in FIG. 4 for simplicity. Retention system 40 generally comprises an adjustable arrangement that passes down from the helmet in front of and behind the ear on each side of the user's head, and that meets in front of and beneath the user's ears and passes under the chin. For ease of discussion and understanding, the helmet retention system will be described as a collection of straps or strap sections but as one of ordinary skill in the art will recognize the preferred helmet retention system is formed from a unitary, continuous strap that is woven throughout the system so that there are no stitched, glued, stapled, etc. joints that could separate easily in the event of an impact condition. There is no "weak link in the chain" so to speak. However, it is contemplated that the helmet retention system for use in the present invention could be formed from a collection of separate and/or joined straps.

Helmet body 2 is generally provided with a transverse groove (not shown) in the helmet body passing over the top, front portion of the helmet body under the shell (not shown) and a cavity (not shown) at the rear of the helmet body located on the centerline of the helmet into which rear strap 10 is inserted or anchored thereto. Front strap 12 passes from below and within the helmet body up and out through an opening (not shown) in the helmet body, across the top of the helmet body in a transverse groove (not shown), and down and back through the helmet body through an opening (not shown) on the other side of the helmet body.

The cavity (not shown) extends generally upwardly through the rearward portion of the helmet body. An impression (not shown) in the upper surface of the helmet body at the point where the cavity emerges accommodates an anchor (not shown) over which rear strap 10 passes. The rear strap 10 passes from its junction with the front strap 12 on the right side of the user's head, up through the cavity, over the anchor and back down through the cavity to its junction with the front strap 12 on the left side of the user's head. Chin strap 14 (only partially shown) extends between junction point 16 on the right side of the user's head under the chin to a junction point (not shown) on the left side of the user's head. The chin strap can be provided with an adjustment mechanism and buckle under the user's chin or near one of the junction points. Generally speaking, rear strap 10, front strap 12, and chin strap 14 make up a strap unit. The strap units are positioned on opposite sides of the user's head and are essentially mirror images of one another. The adjustment mechanism (not shown) allows the user to tighten the retention system 40 to the user's head.

A close fit of the bicycle helmet 1 to the user's head is important for providing protection from impact. In preferred embodiments, a fit system comprised of a set of pads is provided within the helmet to provide comfortable and stable points of contact of the helmet with the user's head. A rear pad (not shown) on the interior surface of the helmet body provides for a comfortable contact between the helmet and the midparietal region of the head, and a front pad (not shown) provides for a comfortable contact between the helmet and the frontal region of the head. These pads additionally have the effect of holding portions of the inner wall of the helmet slightly away from the skin of the user's head. Preferably, the pads are a sandwich construction, filled with a soft resilient polymer layer, such as a polyester foam. They can be provided on the hair and skin-contacting surface with a breathable material such as the material marketed by Malden Mills under the name Polartech™. The pads are preferably held in place in the helmet by hook-and-loop fasteners, such as are known generally under the trademark Velcro®. The hook elements can be affixed using for example a pressure-sensitive adhesive at selected points in the helmet body, and the pads can be provided on the helmet-facing surface with, for example, a brushed nylon that adheres well to the hook elements.

Generally, a bicycle helmet 1 according to the present invention can be fabricated using techniques known in the art. The helmet body 2 can be constructed of any firm, lightweight material. Preferred materials includes gas-expandable synthetic polymers formed using molding techniques generally known in the art. Expandable polystyrene ("EPS") is a preferred expandable polymer for use in forming the helmet body 2 according to the present invention; such polymers are commercially available, marketed for example by General Electric Company under the tradename "GE-CET". Other gas expandable polymers may alternatively be used as, for example, expandable polypropylene or urethane.

The helmet body 2 can be at least partially covered with a thin shell (not shown) shaped and cut to conform to a portion of the helmet body surface. The shell preferably is made from sheetstock of a thermoformable polymer such as a polyester teraphthylate glycol ("PETG"). Fabrication of the shell is as follows. A form is provided, having a surface configuration corresponding to the shape of the helmet body portion to be covered by the shell. A sheet of thermoformable polymer is first heated then drawn over or into the form using vacuum or its equivalent. The formed polymer piece is then trimmed to form its peripheral edge and any vents that may be desired are cut out. The resulting trimmed and cut shell is then pulled over the completed helmet body, which it closely fits, and the shell edge is taped onto the periphery of the helmet body using an elastic tape, such as a vinyl tape having a pressure sensitive adhesive. The shell may be affixed to helmet body 2 by any convenient means. The shell and helmet body can, for example, be bonded together by an adhesive, such as a contact adhesive, over much of the opposed surfaces of the shell and helmet body or they can be joined only at the peripheral edge of the shell using a contact adhesive tape. The shell can be decorated by inks or pigments; to the extent the completed shell is opaque, it can hide surface irregularities and conceal the straps, giving the helmet a finished appearance. More significantly from the standpoint of safety, the shell can serve to preserve the overall integrity of the helmet even after a portion of the helmet body has been damaged by a first impact, so that the helmet remains in place on the user's head to provide at least limited continuing protection in the event of additional impacts that may occur as the crash situation develops.

While the invention has been described in detail with reference to specific embodiments thereof, it will be apparent to one skilled in the art that various changes and modification can be made, and equivalents employed, without departing from the spirit and scope of the invention.

What is claimed is:

1. A protective bicycle helmet comprising:

a helmet body having a crown portion and a rear skirt portion below the crown portion, the rear skirt portion comprising at least two generally vertical columns extending from an upper rim of the rear skirt portion to a lower rim of the helmet body, the at least two generally vertical columns being configured to provide a rigid support structure for the protective bicycle helmet.

2. The helmet of claim 1 wherein the generally vertical columns have an opening therebetween through the helmet body.

3. The helmet of claim 2 wherein the number of generally vertical columns is four or greater and the number of openings is three or greater.

4. The helmet of claim 1 wherein the vertical columns extend down from the crown portion of the helmet body such that at least a distal portion of the vertical columns extends below the occipital protuberance of the bicyclist.

5. The helmet of claim 1 wherein the rear skirt portion is substantially below an imaginary curve which generally follows an outermost perimeter of the helmet body when viewed in a top plan view.

6. The helmet of claim 1 further comprising an opening through the rear skirt portion of the helmet body located outboard of each of the generally vertical columns.

7. The helmet of claim 1 wherein one of the generally vertical columns is located substantially on a centerline of the helmet body.

8. The helmet of claim 1 wherein the generally vertical columns are spaced on opposite sides of a centerline of the helmet body.

9. The helmet of claim 1 wherein a depth of each generally vertical column is from an outside surface of the rear skirt portion to an inside surface of the rear skirt portion.

10. The helmet of claim 9 wherein the depth of each generally vertical column varies along a height of the column.

11. The helmet of claim 10 wherein the depth of the generally vertical column is greater at a top of the column than at a mid-section of the column.

12. The helmet of claim 10 wherein the depth of the generally vertical column at a bottom of the column is greater than at a mid-section of the column.

13. The helmet of claim 9 wherein the generally vertical columns are thicker at the intersection with the inside surface of the helmet body and thinner at the intersection with the outside surface of the helmet body.

14. The helmet of claim 1 wherein the number of generally vertical columns is four or greater.

15. The helmet of claim 1 wherein the generally vertical columns are connected by a support member.

16. A protective bicycle helmet, comprising:

a helmet body having a crown portion and a skirt portion along an imaginary curve which generally follows an outermost perimeter of the helmet body when the helmet body is viewed in a top plan view, a rearward most portion of the skirt comprising at least four pillars configured to provide a rigid support structure for the protective bicycle helmet and at least three openings to provide air ventilation for the skirt portion.

17. The helmet of claim 16 wherein a depth of each pillar is from an outside surface of the rear skirt portion to an inside surface of the rear skirt portion.

18. The helmet of claim 16 wherein a depth of each pillar varies along a height of the pillar.

19. The helmet of claim 18 wherein the depth of the pilar is greater at a top of the pillar than at a mid-section of the pillar.

20. The helmet of claim 18 wherein the depth of the pillar at a bottom of the pillar is greater than at a mid-section of the pillar.

21. A bicycle helmet, comprising:

a helmet body having at least two generally vertical columns with at least a substantial portion of the columns extending below a rearward most point of the helmet and spaced on opposite sides of a centerline of the helmet body, the generally vertical columns being configured to provide a rigid support structure for the bicycle helmet.

22. The bicycle helmet of claim 21 wherein the generally vertical columns are orientated at an angle of about 45 degrees or less from vertical.

23. The bicycle helmet of claim 21 wherein the generally vertical columns have an opening therebetween through the helmet body.

24. The bicycle helmet of claim 21 wherein the generally vertical columns have an opening that is generally taller than wide therebetween.

* * * * *

UNITED STATES PATENT AND TRADEMARK OFFICE

CERTIFICATE OF CORRECTION

PATENT NO. : 6,055,675
DATED : May 2, 2000
INVENTOR(S) : F. Robert Egger; Kurt Workman; Steven Sasaki It is certified that error appears in the above-identified patent and that said Letters Patent is hereby corrected as shown below:

Column 6, claim 19,
Line 44, please replace "of the pilar" with -- of the pillar --.

Signed and Sealed this

Nineteenth Day of March, 2002

*Attest:*

*Attesting Officer*

JAMES E. ROGAN
*Director of the United States Patent and Trademark Office*